US007581418B2

(12) United States Patent
Sedon et al.

(10) Patent No.: US 7,581,418 B2
(45) **Date of Patent: *Sep. 1, 2009**

(54) SECURITY CONTAINER WITH LINKED PRIMARY AND SECONDARY SECURITY FEATURES

(75) Inventors: Nicholas M. Sedon, Massillon, OH (US); Dennis D. Belden, Jr., Canton, OH (US); William Shepler, Brunswick, OH (US)

(73) Assignee: Checkpoint Systems, Inc., Thorofare, NJ (US)

( * ) Notice: Subject to any disclaimer, the term of this patent is extended or adjusted under 35 U.S.C. 154(b) by 1 day.

This patent is subject to a terminal disclaimer.

(21) Appl. No.: 11/801,227

(22) Filed: May 9, 2007

(65) Prior Publication Data

US 2007/0209407 A1 Sep. 13, 2007

Related U.S. Application Data

(63) Continuation of application No. 11/595,020, filed on Nov. 9, 2006, which is a continuation of application No. 10/371,570, filed on Feb. 21, 2003, now Pat. No. 7,194,879.

(51) Int. Cl.
*E05B 65/00* (2006.01)
*B65D 55/02* (2006.01)

(52) U.S. Cl. ..... 70/57.1; 70/58; 70/63; 206/1.5; 206/308.2

(58) Field of Classification Search ..... 70/57–58, 70/63; 292/300, 302; 109/25, 41; 206/1.5, 206/807, 308.1–308.2, 387.11
See application file for complete search history.

(56) References Cited

U.S. PATENT DOCUMENTS 2,269,537 A 1/1942 Krause
4,649,723 A 3/1987 Appelbaum
5,372,021 A 12/1994 Smith
5,738,393 A 4/1998 Chao
5,782,350 A * 7/1998 Weisburn et al. ..... 70/63
5,904,246 A 5/1999 Weisburn et al.
5,918,554 A 7/1999 Rassamni
5,979,339 A 11/1999 Smith
6,125,668 A 10/2000 Beldon, Jr.
6,178,897 B1 * 1/2001 Appeltans et al. ..... 109/33
6,422,616 B1 7/2002 Wortmann et al.
8,485,071 11/2002 Schwaiger
8,497,125 12/2002 Necchi
6,601,701 B1 8/2003 Belden et al.
8,601,414 8/2003 Chang
6,637,589 B2 10/2003 Broadhead
6,666,330 B2 12/2003 Sedon et al.
6,701,854 B1 * 3/2004 Gral ..... 109/25
6,832,498 B2 12/2004 Belden et al.
6,926,164 B1 8/2005 Broadhead et al.
7,100,402 B2 9/2006 Holmgren
2004/0200744 A1 10/2004 Mitzuyama

* cited by examiner

*Primary Examiner*—Peter M Cuomo
*Assistant Examiner*—Christopher Boswell
(74) *Attorney, Agent, or Firm*—Sand & Sebolt

(57) ABSTRACT

A security storage container has a primary security feature that is adapted to be locked and unlocked with an appropriate key. A secondary security feature is activated when the security storage container is opened without first unlocking the lock with the key. In one embodiment, the secondary security feature includes prongs that are moved to an extended position when the primary security feature of the container is defeated. In the extended position, the prongs will at least damage the item of merchandise protected by the security storage container. The extended position of the prongs may also further lock the item of merchandise within the security storage container.

32 Claims, 36 Drawing Sheets

SECURITY CONTAINER WITH LINKED PRIMARY AND SECONDARY SECURITY FEATURES

CROSS REFERENCE TO RELATED APPLICATIONS

This application is a continuation of U.S. patent application Ser. No. 11/595,020, filed Nov. 9, 2006, which is a continuation of U.S. patent application Ser. No. 10/371,570, filed Feb. 21, 2003, now U.S. Pat. No. 7,194,879; the disclosures of which are incorporated herein by reference.

BACKGROUND OF THE INVENTION

1. Technical Field

The present invention generally relates to security storage containers and, more particularly, to a security container with linked primary and secondary security features. Specifically, the present invention relates to a security container having linked security features wherein a forced defeat of the primary security feature activates the secondary security feature. In the exemplary embodiment of the invention, activation of the secondary security device damages the item of merchandise received in the container.

2. Background Information

Many different types of security storage containers are known in the art. Most security storage containers are intended to securely lock an electronic article surveillance (EAS) device to an item of merchandise in order to frustrate shoplifters. Known devices include six-sided boxes that receive items of merchandise, frames that surround portions of merchandise, and straps that pass through or around portions of merchandise. These devices are especially effective against impulse shoplifters. Although also effective against professional shoplifters, the professional shoplifter will eventually obtain a sample of the security storage container and determine a quick method for defeating the container. For instance, the shoplifter may develop a pick that opens the lock of the device. The shoplifter may also use a tool that breaks a portion of the device rendering its security function useless. Once a shoplifter breaks a security device, the item of merchandise protected by the device may be separated from the device wherein the item of merchandise is no longer protected by the EAS tag.

When items of merchandise are displayed in six-sided security containers, shoplifters have been known to pry the lid open or to strike the lid of the container against a solid object in the store until the lid breaks allowing the shoplifter to remove the item of merchandise. Manufacturers of security storage containers have responded to these attacks by beefing up the security storage containers making them harder and harder to break open. Although these efforts have been successful, the clear plastic materials that allow the customer to view the contents of the security container have strength limitations that make it all but impossible to design a container that can be affordably manufactured while preventing all entry by breakage. The art thus desires a secondary security feature that is activated when a security storage container is attacked with force.

BRIEF SUMMARY OF THE INVENTION

The invention provides a security storage container having a primary security feature that is adapted to be locked and unlocked with an appropriate key. The security storage container includes a secondary security feature that is activated when the security storage container is opened without first unlocking the lock with the key. The secondary security feature frustrates the shoplifter who defeats the primary security feature by force.

In one embodiment, the invention provides a security storage container having a secondary security feature in the form of prongs that are moved to an extended position when the primary security feature of the container is defeated. In the extended position, the prongs will at least damage the item of merchandise protected by the security storage container. The extended position of the prongs may also further lock the item of merchandise within the security storage container.

In another embodiment, the invention provides a security storage container having a secondary security feature in the form of tearing prongs that are adapted to damage the item of merchandise protected by the security storage container when the primary security feature of the container is defeated by force.

BRIEF DESCRIPTION OF THE SEVERAL VIEWS OF THE DRAWINGS

FIGS. 13 and 13A shows the inactivated position of the secondary security feature.

FIG. 15 also shows the activated position of the secondary security feature.

Similar numbers refer to similar parts throughout the specification.

DETAILED DESCRIPTION OF THE INVENTION

Figure 1:
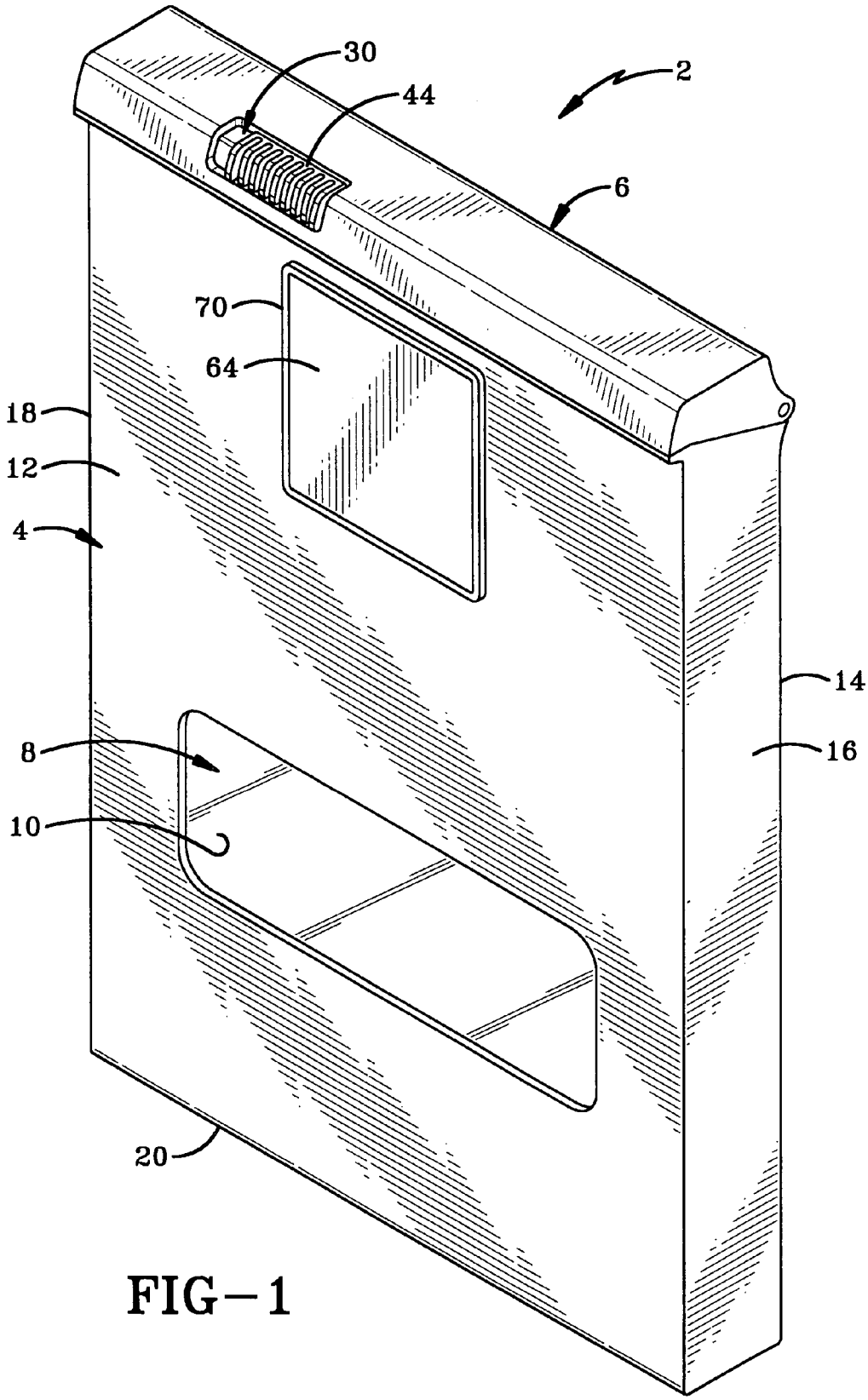
FIG. 1 is a perspective view of an exemplary security storage container including the secondary security feature of the present invention.
Figure 2:
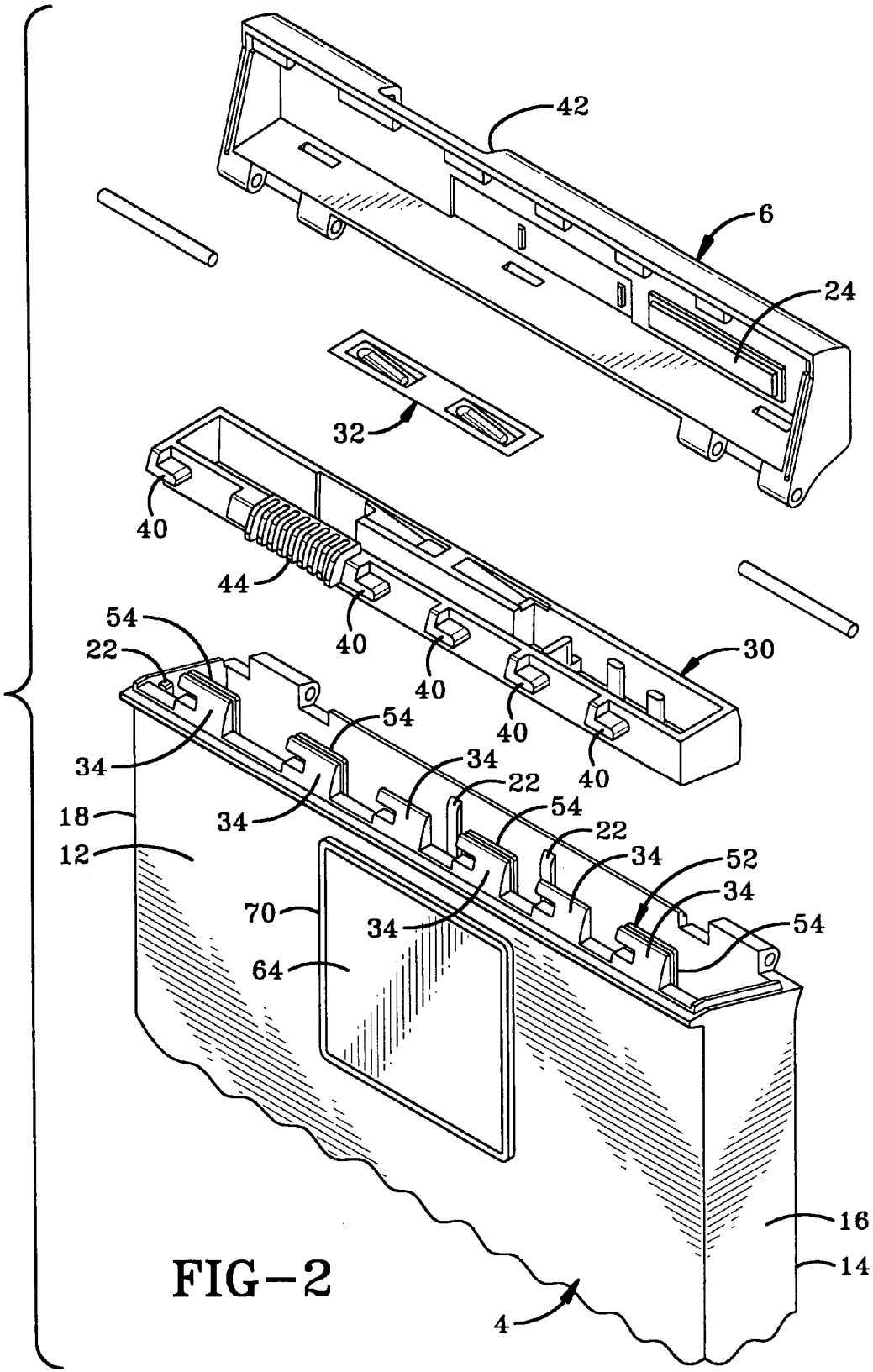
FIG. 2 is an exploded view of the lid portion of the security storage container of FIG. 1.
Figure 3:
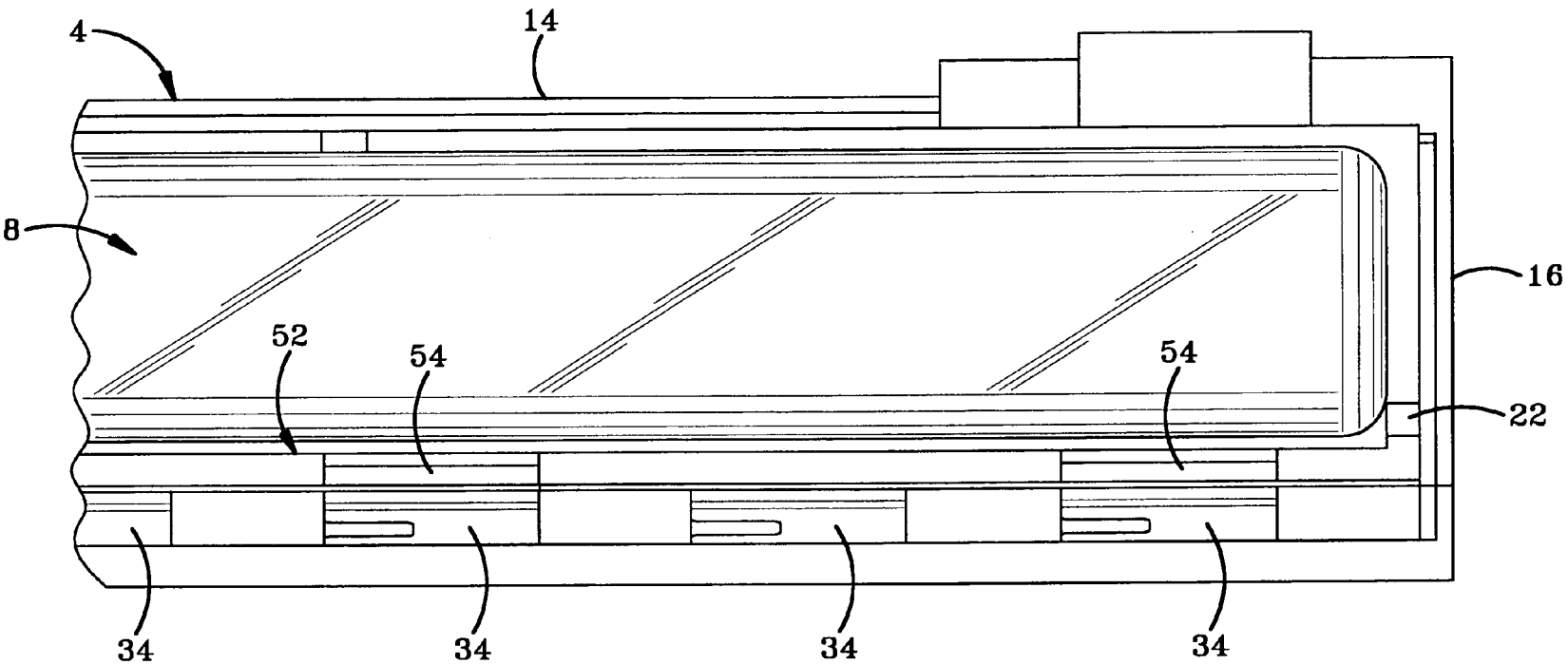
FIG. 3 is a top plan view of the right side of the base of the container of FIG. 2 showing an item of merchandise received within the base of the container.

An exemplary embodiment of the security storage container of the present invention is indicated generally by the numeral 2 in the accompanying drawings. Security storage container 2 includes a primary security feature that may be unlocked with a key to allow the item of merchandise protected by container 2 to be removed from container 2 and sold to a customer. Security storage container 2 also includes a secondary security feature that is activated only when the primary security feature is defeated by force. The secondary security feature functions by locking the item of merchandise to a portion of security storage container 2 or by damaging a portion of the item of merchandise. FIGS. 1-21 show a first exemplary embodiment of security storage container 2. FIGS. 22-29 show an alternative embodiment of the secondary security feature for the exemplary embodiment of security storage container 2. FIGS. 30-38 show alternative positions for either embodiment of the secondary security feature. The secondary security feature of the present invention may be used with a wide variety of security storage containers having a primary security feature. The exemplary security storage container 2 shown in the accompanying drawings is provided as the best mode embodiment for this application.

Security storage container 2 is in the form of a six-sided box having a frame or base 4 and a lid 6 that is connected to base 4 and movable between open and closed positions. Base 4 is sized to receive an item of merchandise 8 and lid 6 cooperates with base 4 to surround and secure item 8 when lid 6 is in the closed position. In the exemplary embodiment, container 2 is adapted to receive items 8 of recorded media such as CD or DVD packages. Other embodiments of security container 2 may be configured to hold other types of items 8 such as computer software boxes, books, jewelry boxes, electronics boxes, and the like. Base 4 is typically fabricated from a transparent material that allows the customer to view item 8. Base 4 may include windows 10 that reduce the amount of material used to fabricate base 4 and allow customers to directly view item 8.

Base 4 generally includes a front wall 12, a back wall 14, a right sidewall 16, a left sidewall 18, and a bottom wall 20. Walls 12, 14, 16, 18 and 20 are disposed in the form of a 5-sided frame or box having an open end disposed opposite bottom wall 20. Lid 6 is connected to base 4 with hinges and closes the open end of the box when lid 6 is closed. Ribs 22 may be provided on the inner surface of any of the walls of base 4 to help position item 8 immediately adjacent or against the secondary security feature of container 2. In the exemplary embodiment, ribs 22 are located on the inner surface of back wall 14.

Figure 5:
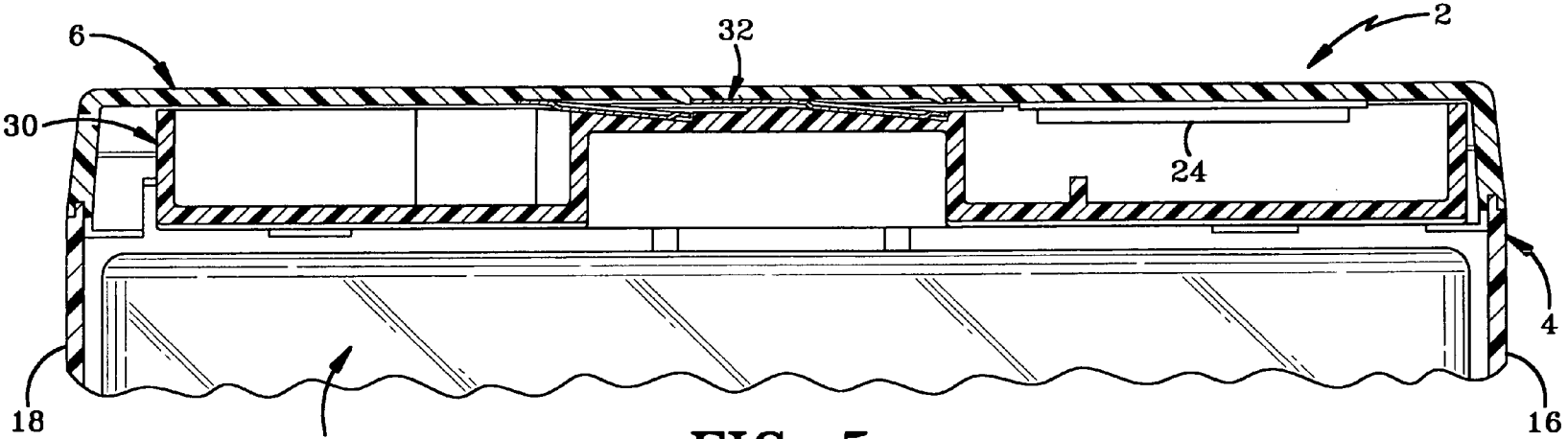
FIG. 5 is a front view, partially in section, showing the primary security feature in the locked position.
Figure 6:
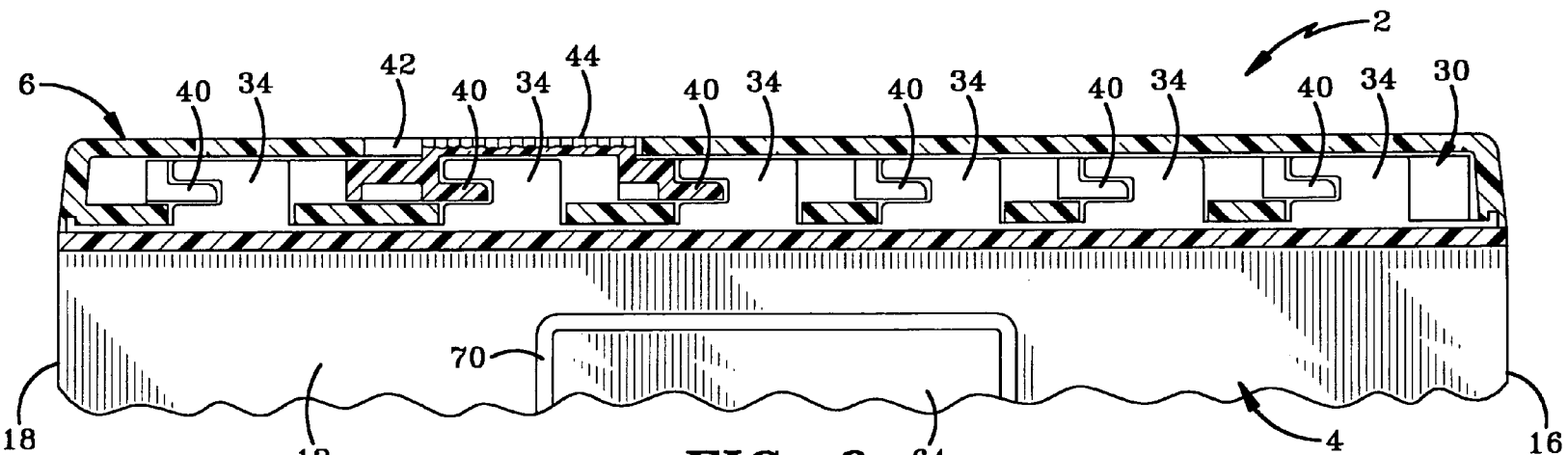
FIG. 6 is a view similar to FIG. 5 showing the lock tabs of the lid engaged with the lock tabs of the base and the lock tabs of the secondary security feature.
Figure 7:
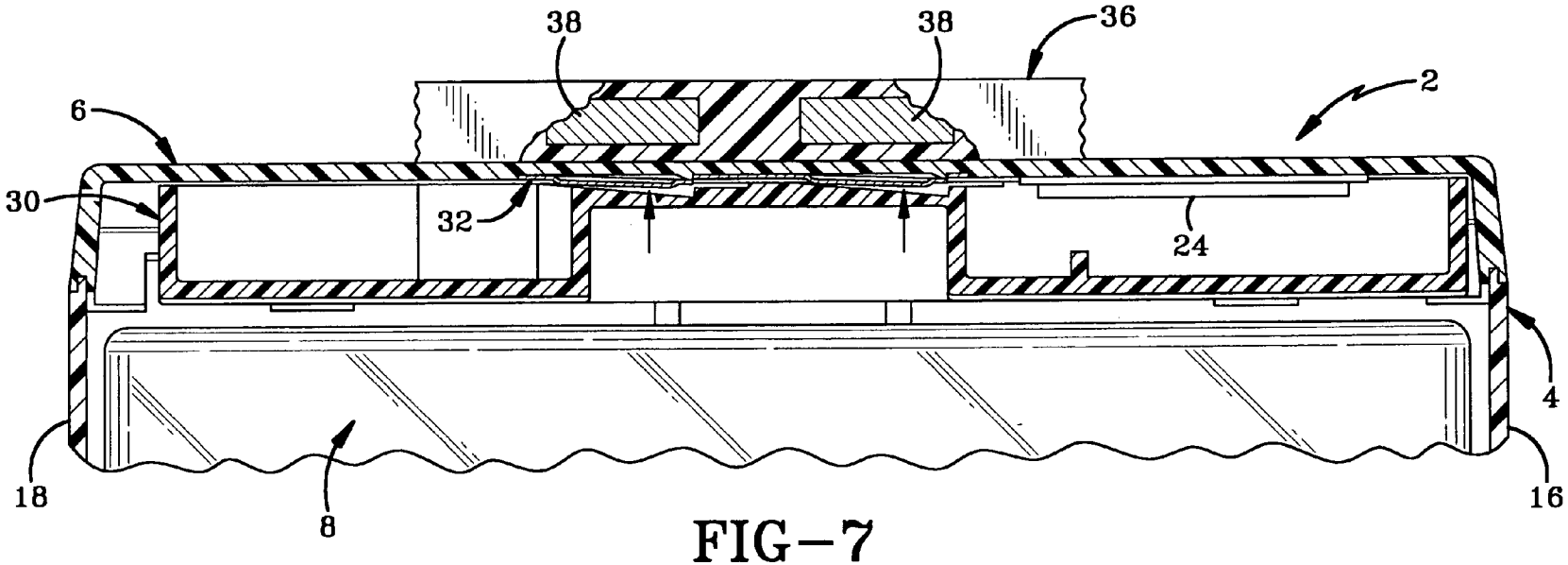
FIG. 7 is a view similar to FIG. 5 showing a key unlocking the primary security feature of the security storage container.
Figure 8:
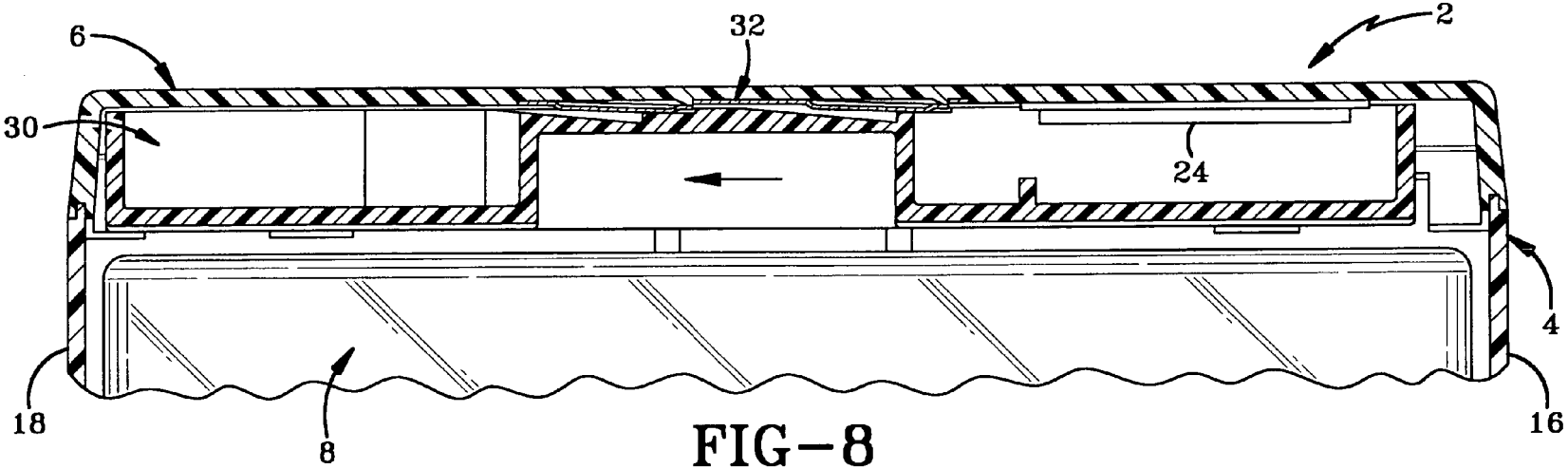
FIG. 8 is a view similar to FIGS. 5 and 7 showing the primary security feature being moved to the unlocked position.
Figure 9:
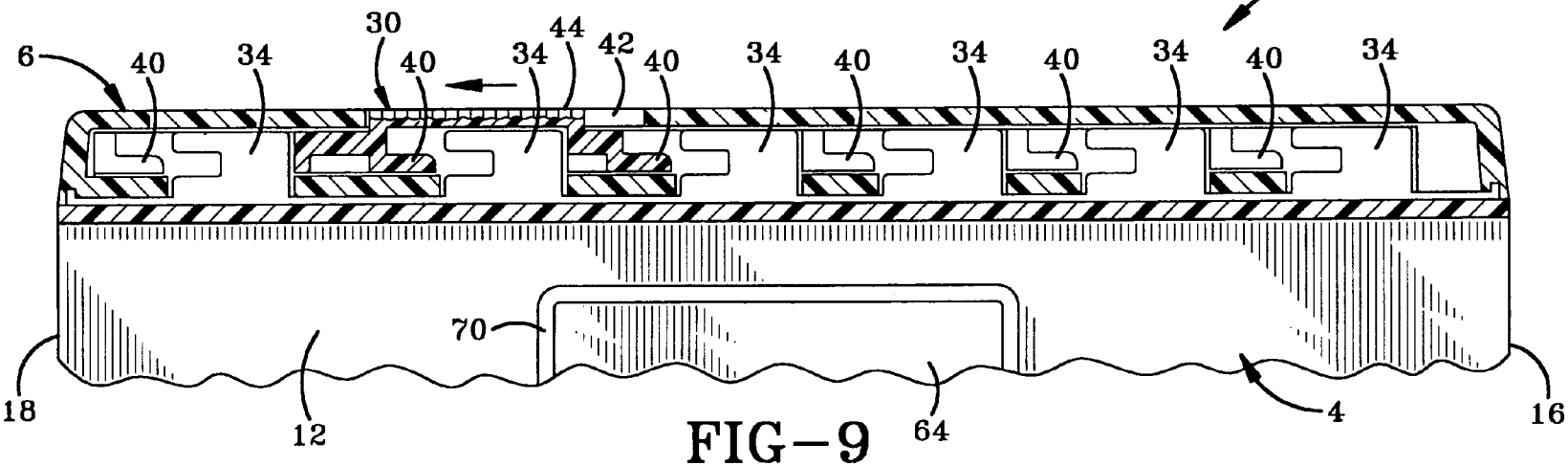
FIG. 9 is a view similar to FIG. 6 showing the position of the lock tabs when the primary security feature is in the unlocked position.

Lid 6 is adapted to carry the EAS tag 24 of container 2 in a compartment defined by lid 6. Lid 6 is typically fabricated from an opaque material so that an observer cannot determine if an EAS 24 is present. An observer also cannot determine how the primary security feature of container 2 is configured. In the exemplary embodiment of the invention, the primary security feature of container 2 locks lid 6 in the closed position with respect to base 4. The primary security feature thus includes a lock slide 30, a locking mechanism 32, and at least one lock tab 34 connected to base 4. Lock slide 30 is carried by lid 6 and selectively moveable between locked and unlocked positions. The locked position is depicted in FIGS. 5 and 6 with the unlocked position depicted in FIGS. 8 and 9. Locking mechanism 32 holds lock slide 30 in the locked position when locking mechanism 32 is in its locked position. Any of a variety of locking mechanisms 32 may be used to hold lock slide 30 in the locked position. These locking mechanisms include mechanically-actuated devices and magnetically-actuated devices. In the exemplary embodiment, a two finger, magnetically-actuated locking mechanism 32 is shown. The locking fingers of locking mechanism 32 may be moved from a locked position (FIG. 5) to an unlocked position (FIG. 7) through the use of an appropriate key 36 having magnets 38 positioned to align with the lock fingers when the key is correctly positioned with respect to lid 6. Locking mechanism 32 may be carried by either lid 6 or lock slide 30 and may engage the other of lid 6 and lock slide 30 depending on the particular design of locking mechanism 32 and key 36.

Lock slide 30 includes its own lock tabs 40 that engage lock tabs 34 of base 4 when lock slide 30 is in its locked position as depicted in FIG. 6. In this position, lid 6 cannot be pivoted to the open position and container 2 is locked. When the user wishes to access container 2, the user unlocks locking mechanism 32 and slides lock slide 30 to the unlocked position (FIG. 9) where lock tabs 40 of lock slide 30 disengage lock tabs 34 of base 4. In this position, lid 6 may be freely pivoted from the closed position to the open position. In the exemplary embodiment of the invention, lid 6 defines an opening 42 that allows the user to access a finger tab 44 on lock slide 30 to slide lock slide 30 back and forth. In other embodiments, a projection from key 36 engages lock slide 30 to move lock slide 30 between the locked and unlocked positions.

Figure 13:
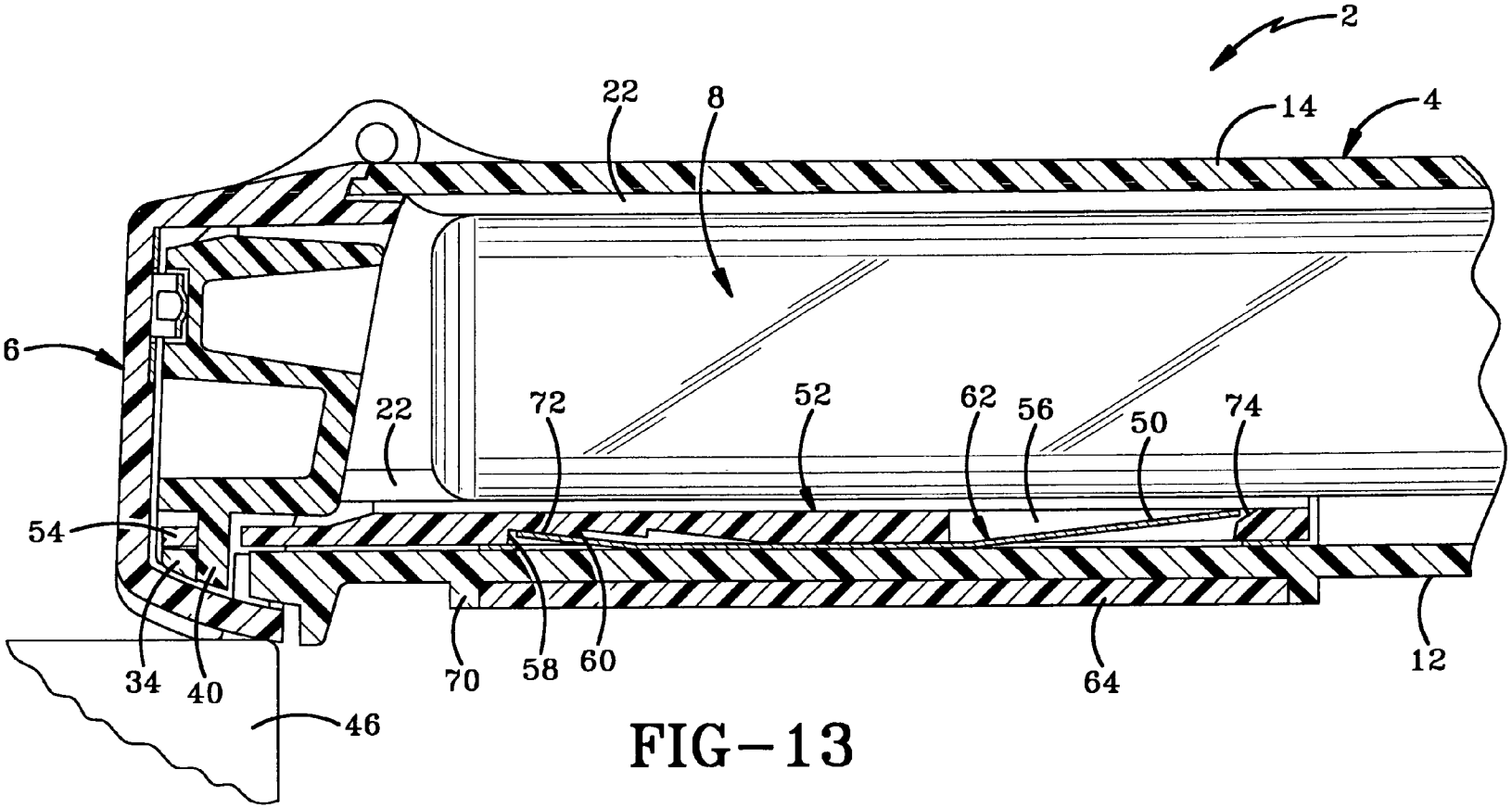
FIGS. 13 and 13A are section views of the security storage container being attacked by force.
Figure 13A:
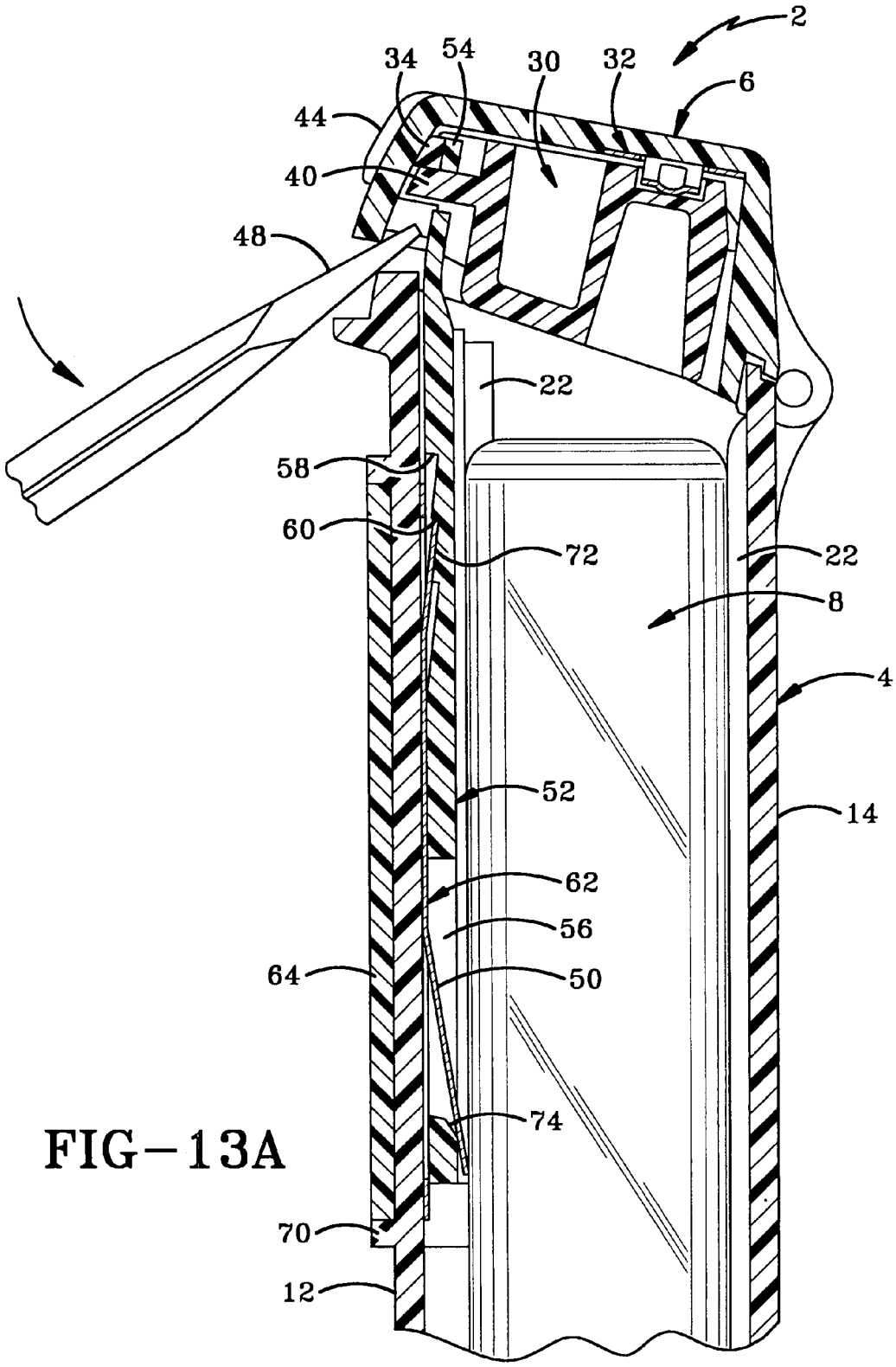

The primary security feature of container 2 is thus adapted to lock lid 6 in the closed position with respect to base 4. Lock tabs 34 and 40 are typically integrally fabricated with lock slide 30 and base 4. Base 4 and lock tabs 34/40 are fabricated from a plastic material that may be fractured if attacked with sufficient force. Two methods of attacking tabs 34/40 are depicted in FIGS. 13 and 13A wherein container 2 is sharply struck against a rigid item 46 and is attacked with a pry bar 48. Once lock tabs 34 or 40 are broken or fractured, lid 6 may be opened without unlocking locking mechanism 32. The secondary security feature of the present invention functions to retain lid 6 when lock tabs 34 or 40 are broken and then, if lid 6 is opened, the secondary security feature of the invention functions to hold item 8 in base 4 or damage item 8 when item 8 is being removed from base 4. The damage to item 8 reduces its value and frustrates the shoplifter.

Figure 22:
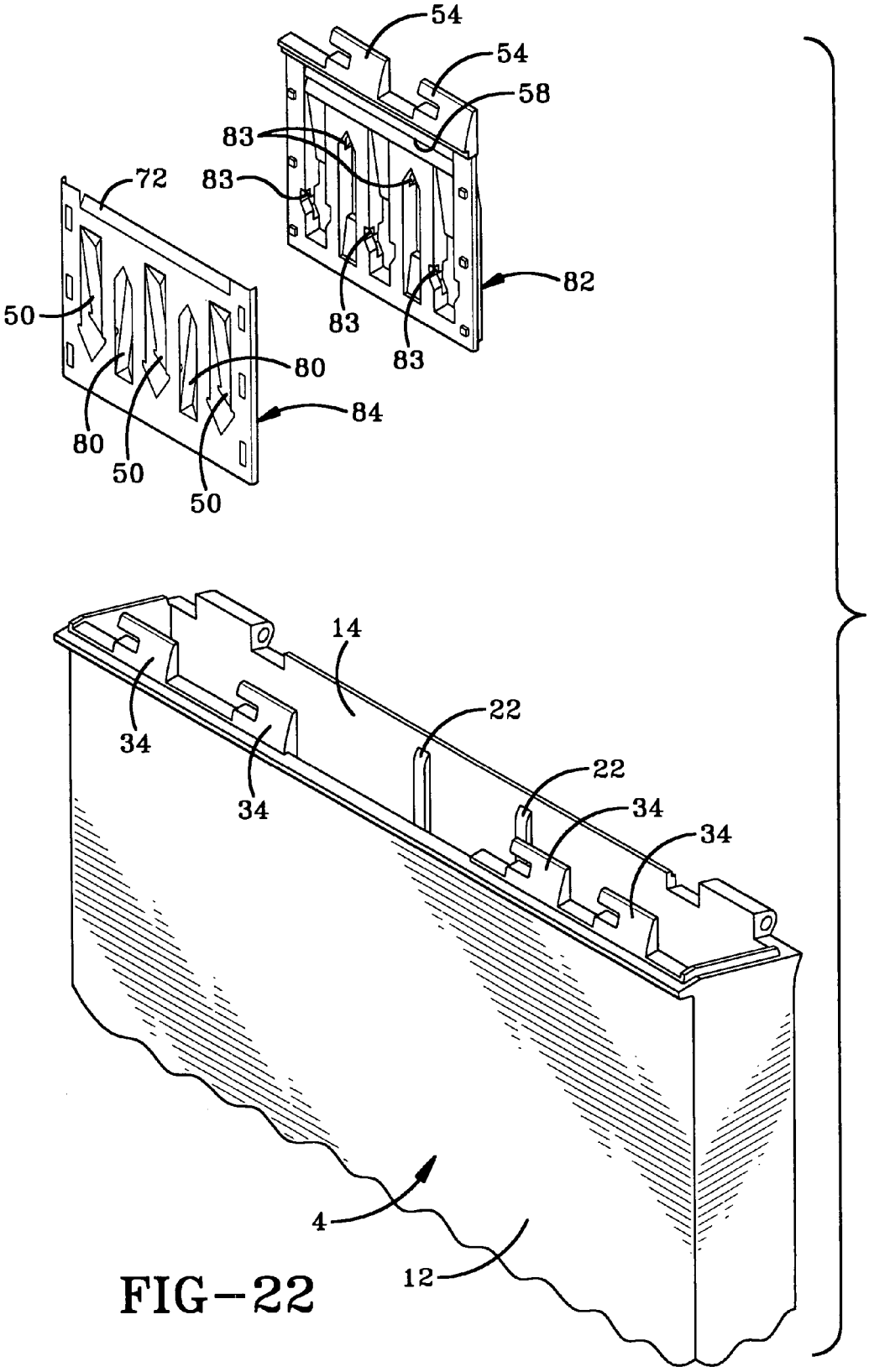
FIG. 22 is a prospective view of an alternative embodiment of the secondary security feature.
Figure 23:
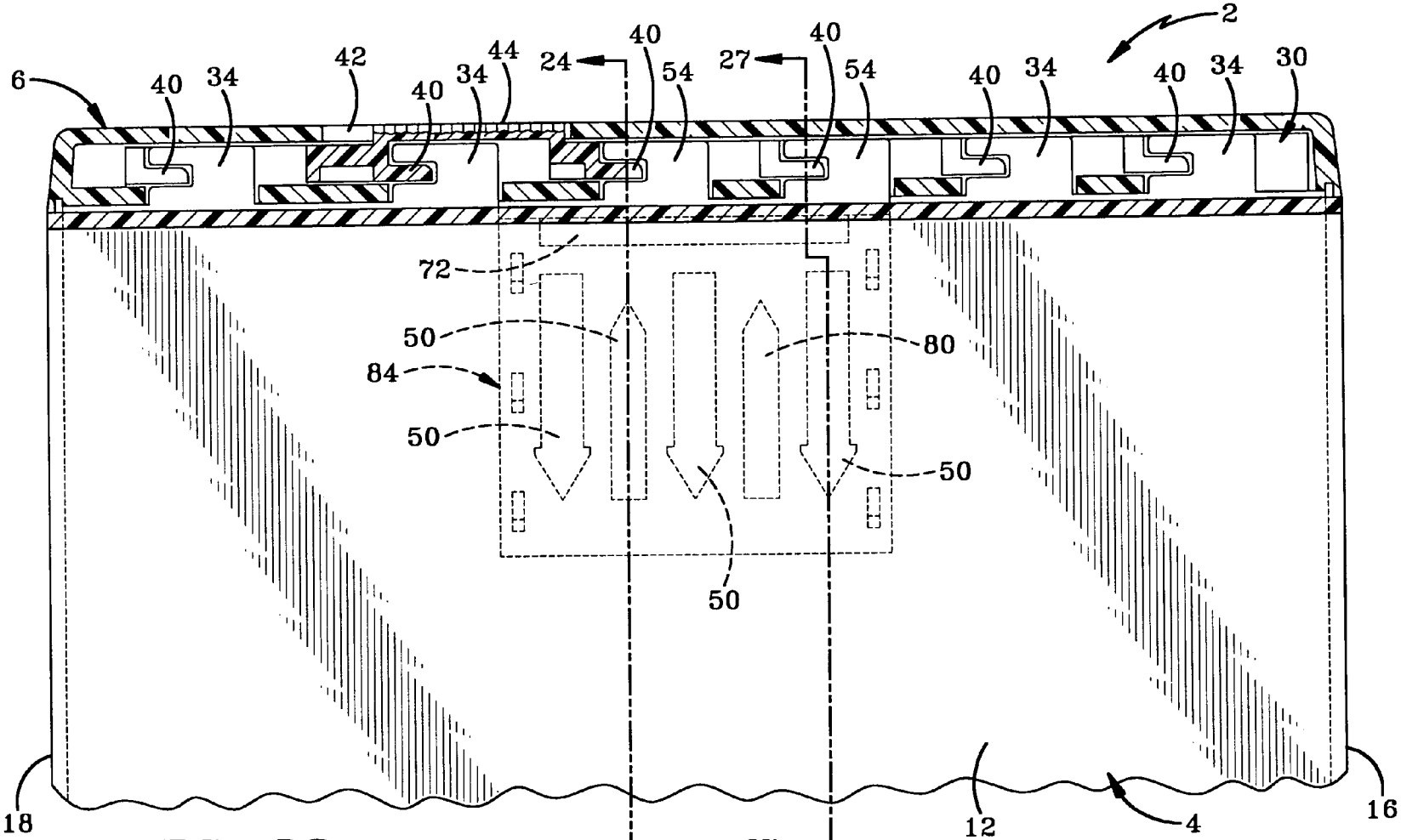
FIG. 23 is a front view, partially in section, showing the locked position of the lock tabs of the lid and base.
Figure 24:
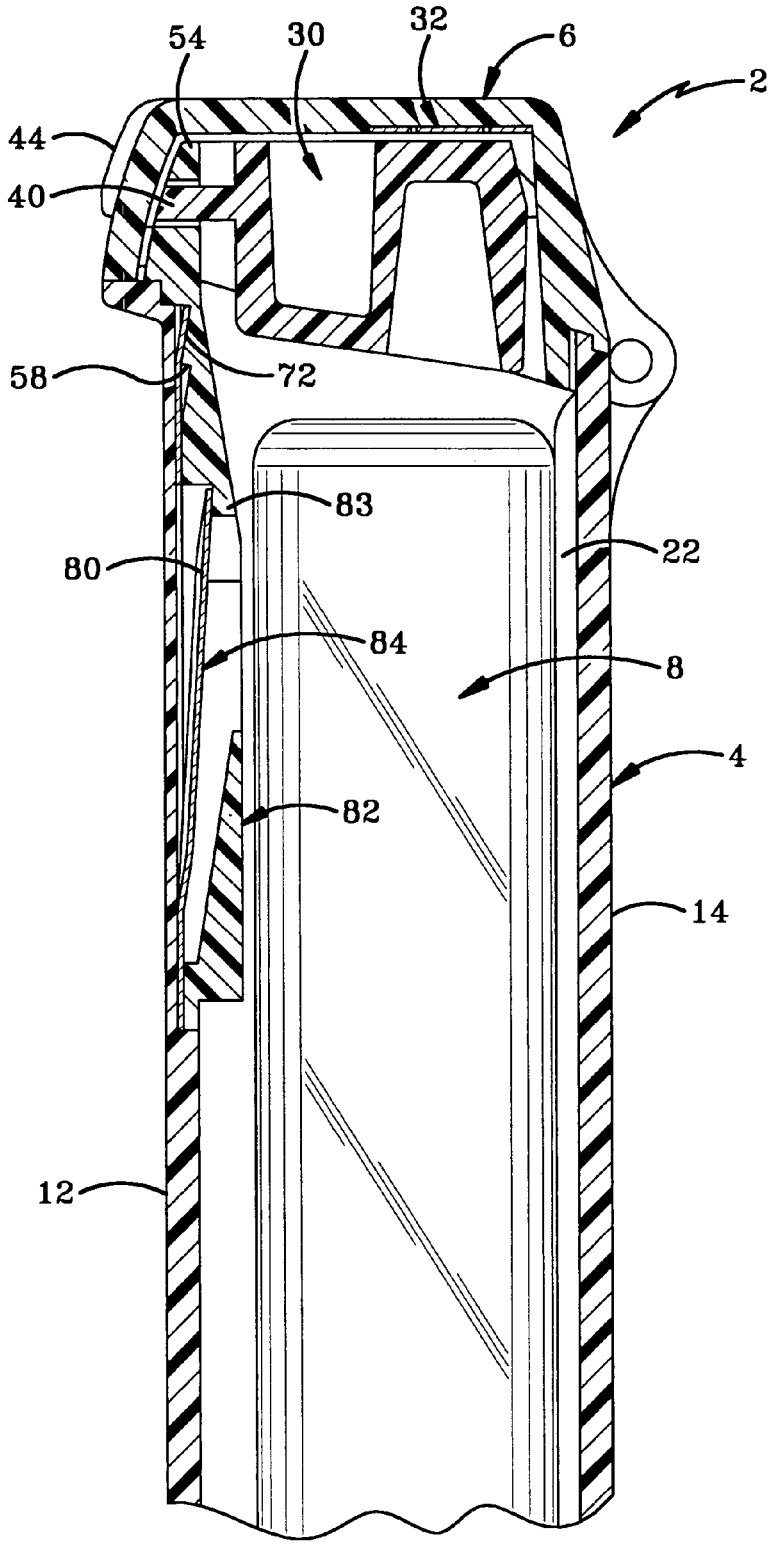
FIG. 24 is a section view taken along line 24-24 of FIG. 23.
Figure 25:
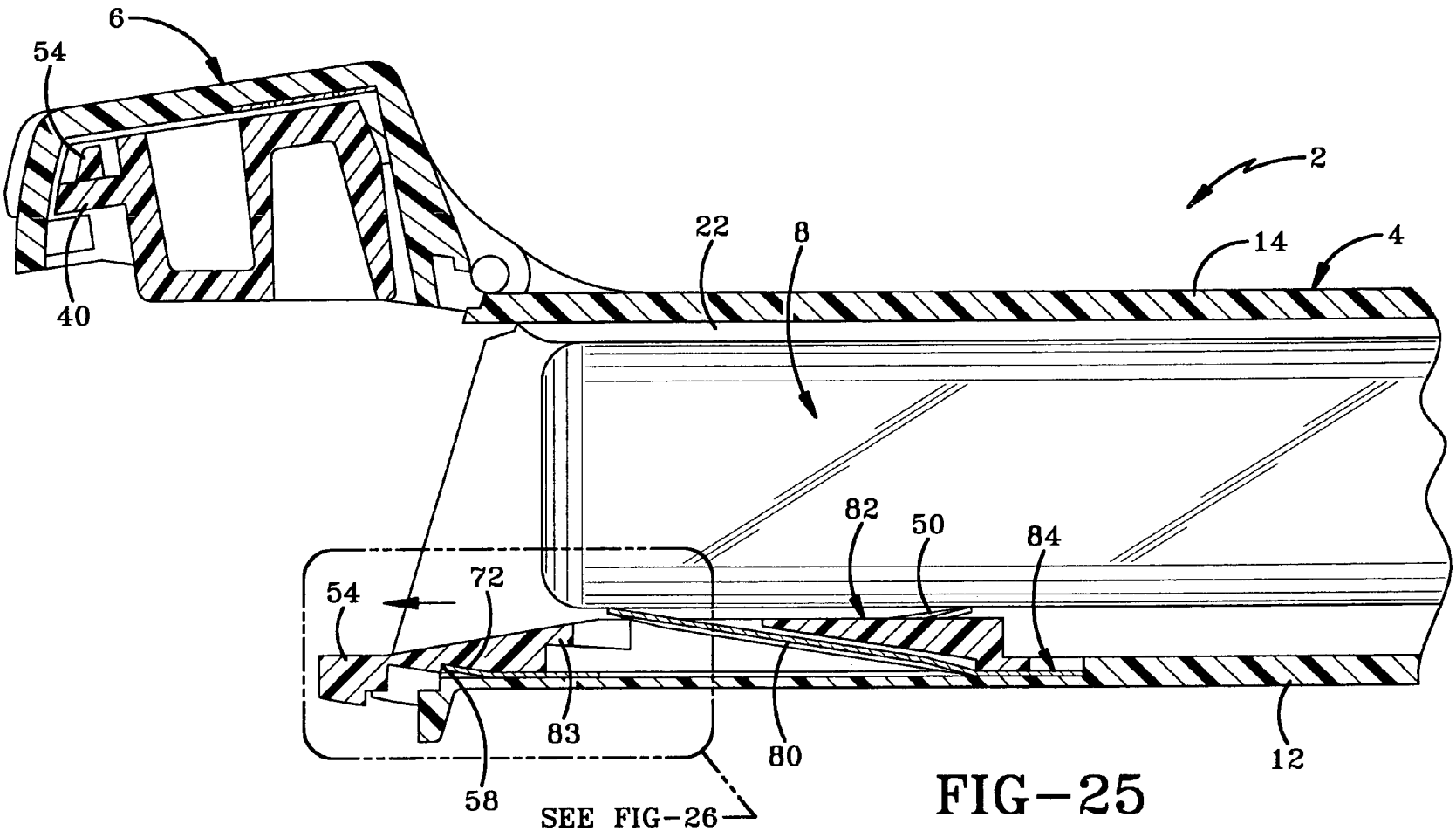
FIG. 25 is a section view showing the lid open with the primary security feature defeated and the secondary security feature in the activated position.
Figure 26:
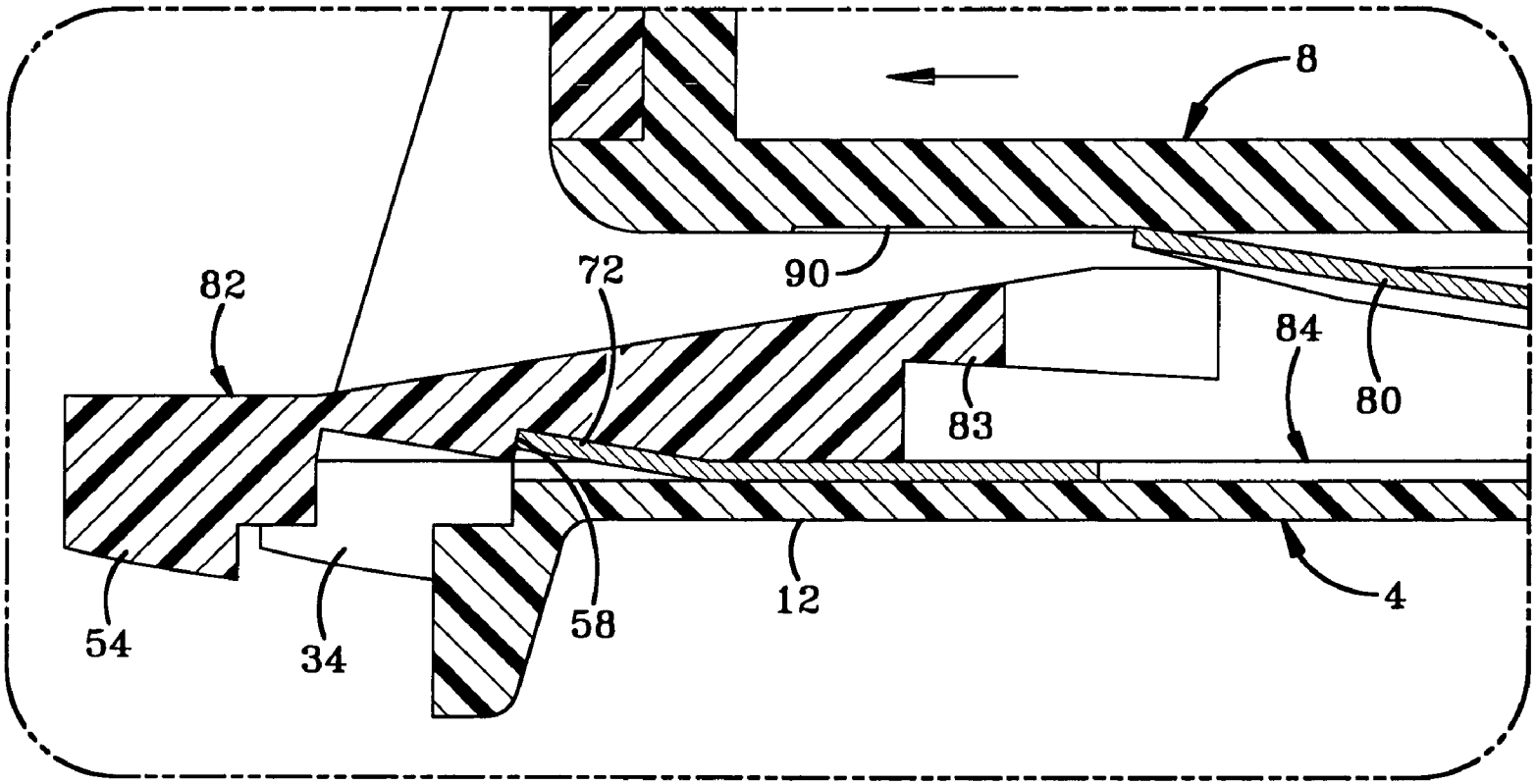
FIG. 26 is an enlarged section view of the encircled portion of FIG. 25.
Figure 27:
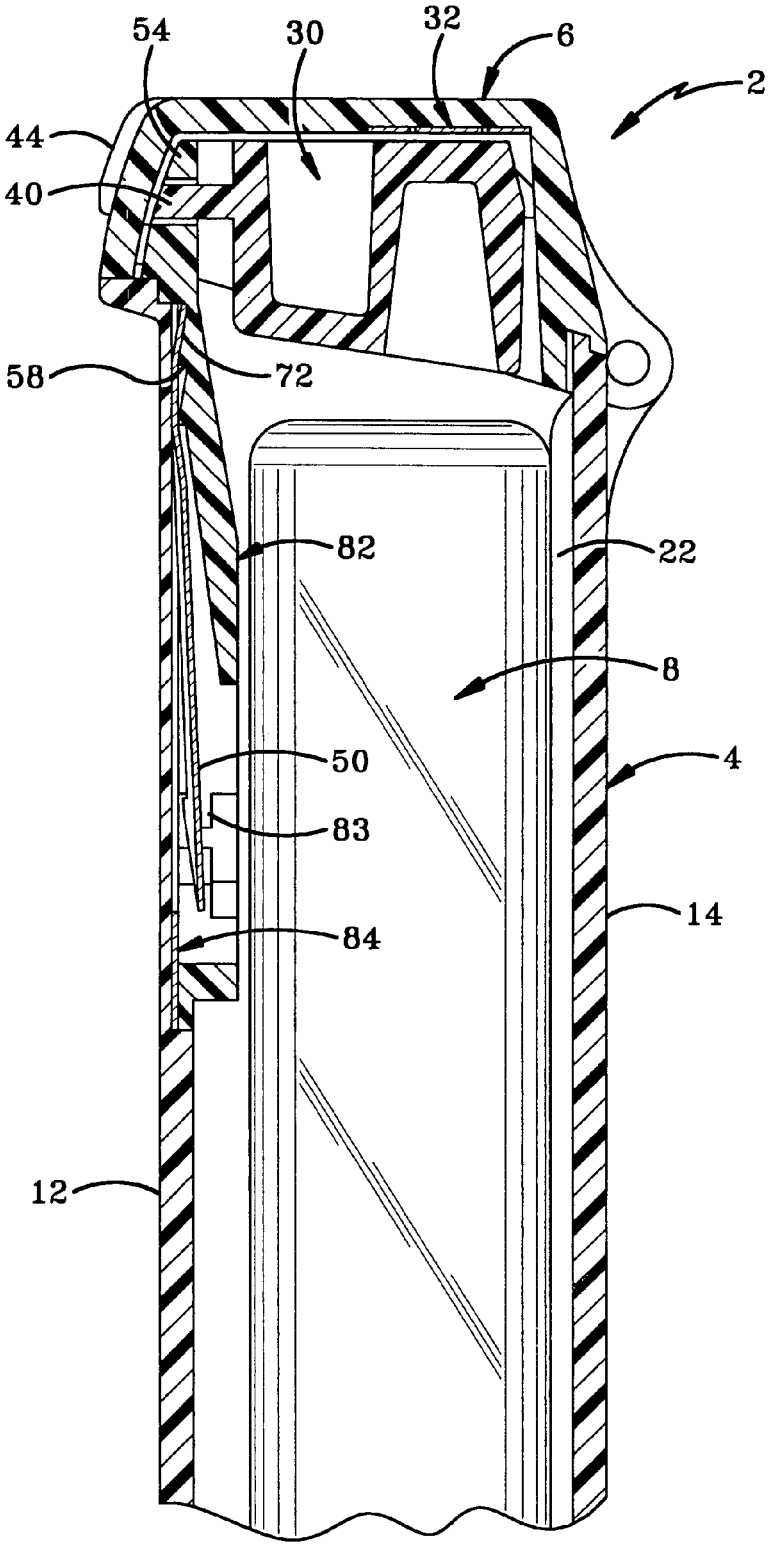
FIG. 27 is a section view taken along line 27-27 of FIG. 23.
Figure 28:
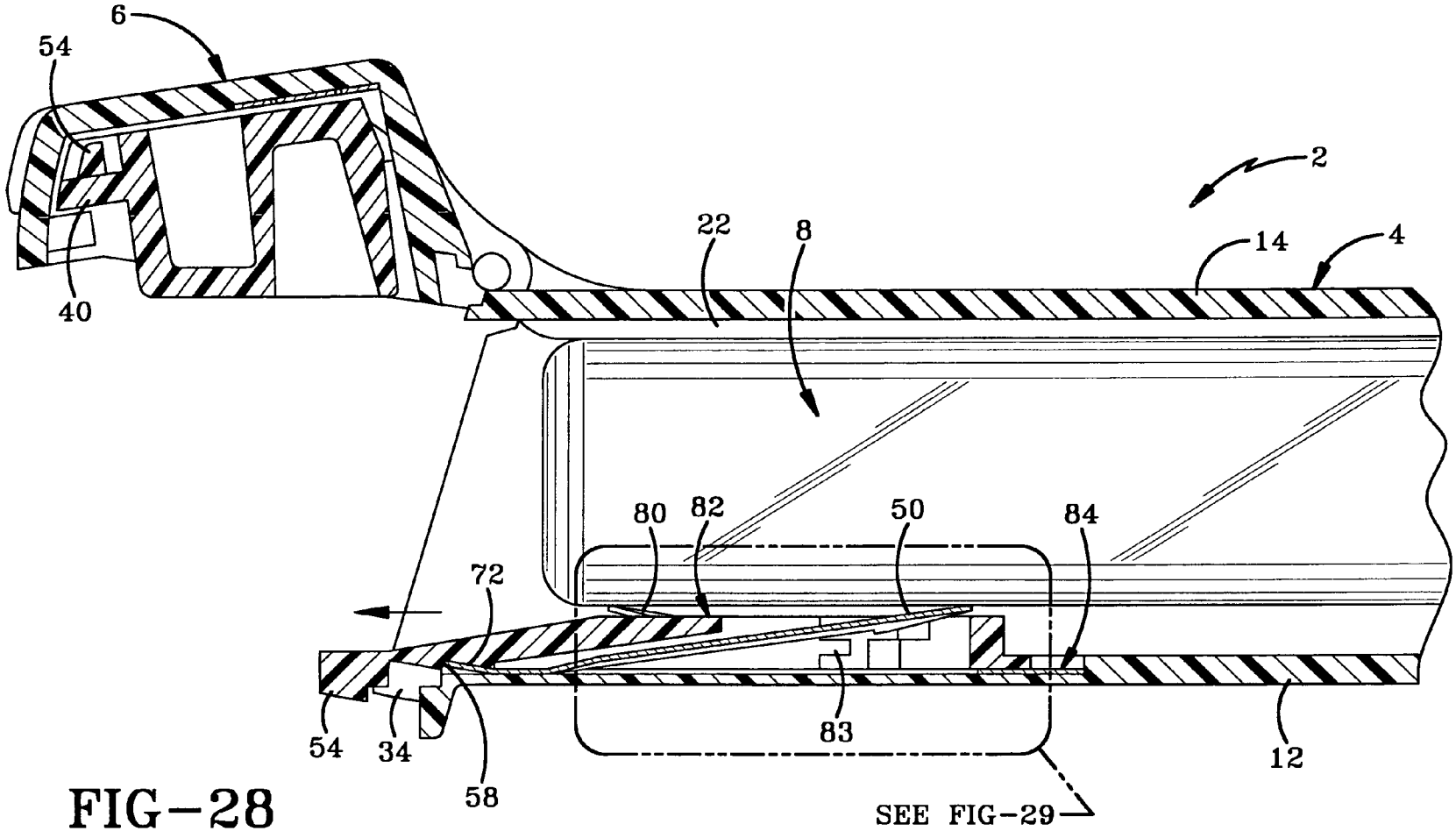
FIG. 28 is a view similar to FIG. 25 showing another portion of the secondary security feature in the activated position.
Figure 29:
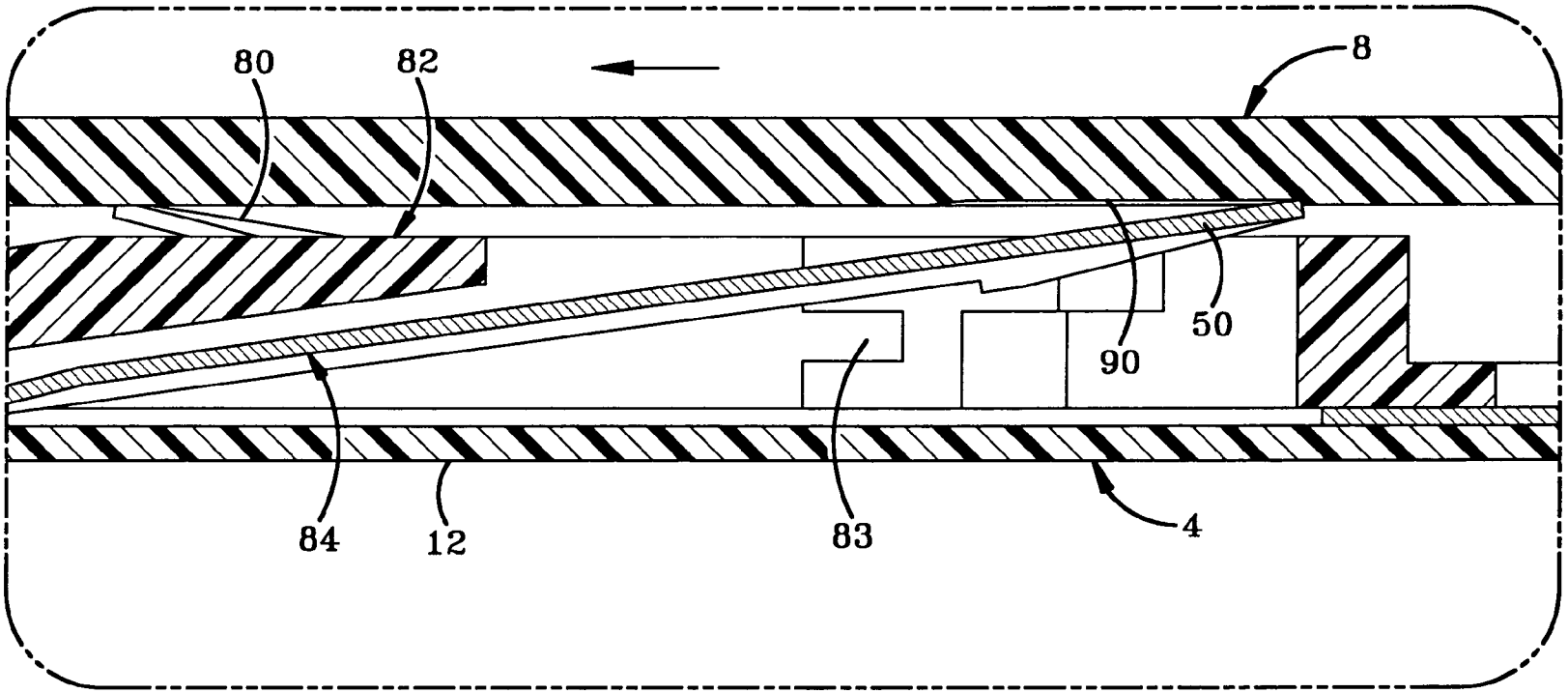
FIG. 29 is an enlarged section view of the encircled portion of FIG. 28.

The secondary security feature of the present invention generally includes at least one prong 50 and a cover member 52 that holds prong 50 in an inactivated position until a portion of the primary security device is defeated. When a portion of the primary security device is defeated, cover member 52 moves to an activated position allowing prong 50 to move to an activated position to engage item 8. The engagement of prong 50 with item 8 will hold item 8 in base 4 or will damage item 8 if item 8 is forcibly removed from base 4 when prong 50 is engaging item 8. Cover member 52 is activated by the defeat of the primary security feature because cover member 52 is linked to a portion of the primary security feature. The link between the primary and second security features causes the secondary security feature to be activated when the primary security feature is defeated. In the exemplary embodiment, the link between the security features is through lock slide 30. Specifically, cover member 52 includes lock tabs 54 that align with lock tabs 34 of base 4 to engage lock tabs 40 on lock slide 30. In one embodiment, lock tabs 54 are fabricated from a material that does not fracture as easily as the material that forms lock tabs 34 thus causing lock tabs 54 to remain engaged with lock slide 30 after lock tabs 34 are destroyed. In another embodiment (such as shown in FIG. 22), lock tabs 54 are disposed in limited positions with respect to tabs 34.

Figure 4:
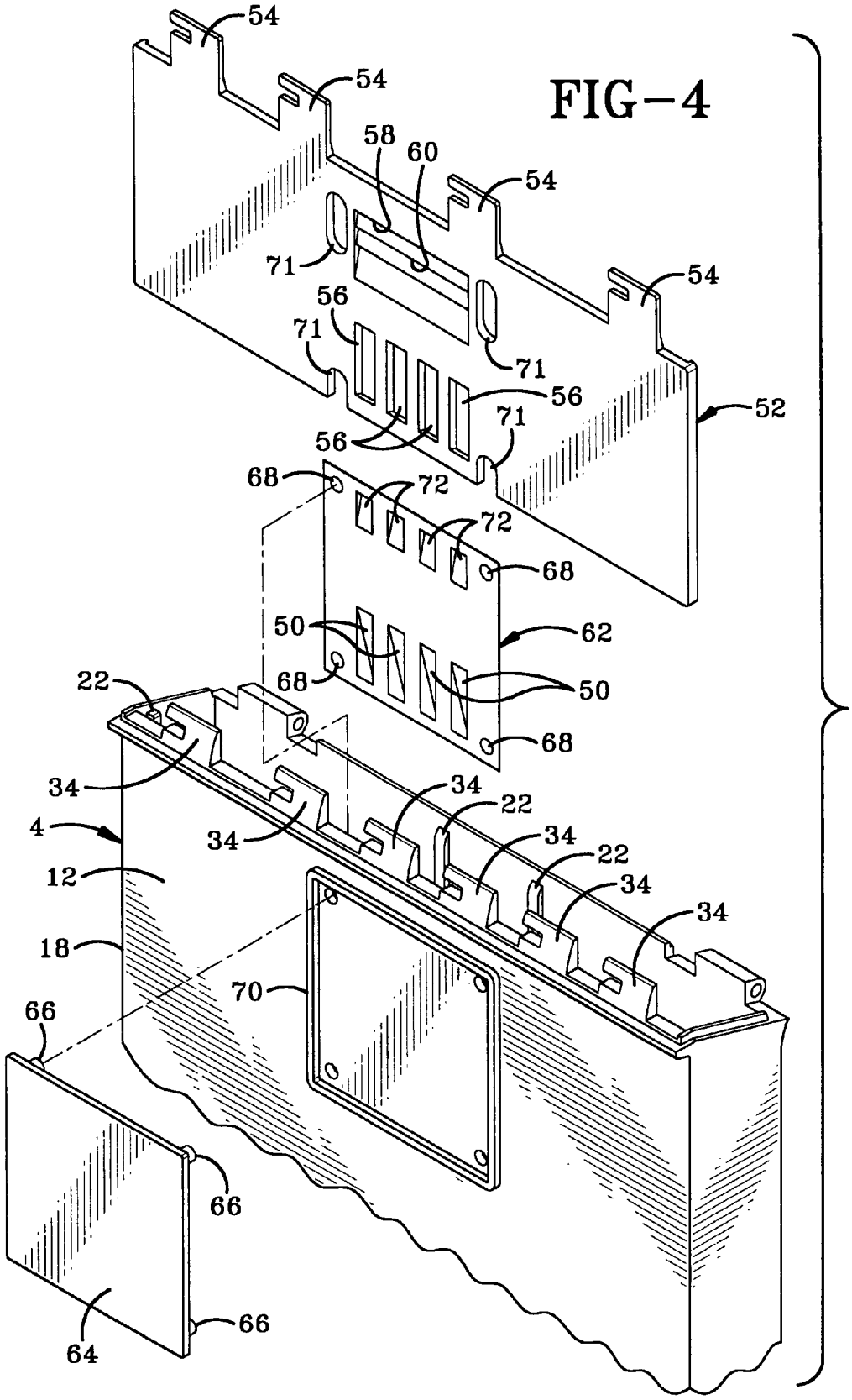
FIG. 4 is an exploded perspective view of the base of the security storage container with the components of the secondary security feature removed from the base.
Figure 11:
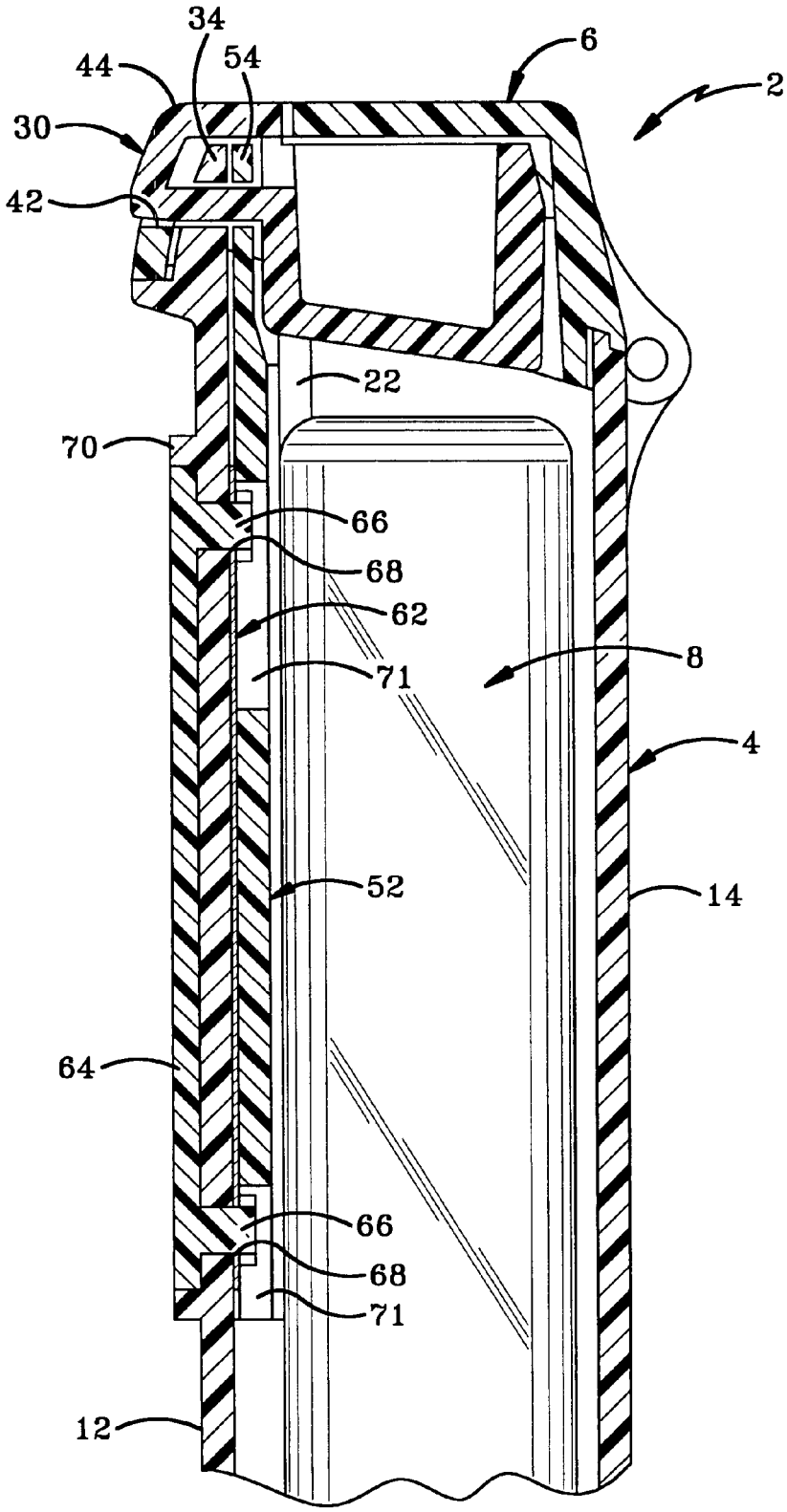
FIG. 11 is a section view taken along line 11-11 of FIG. 10.
Figure 12:
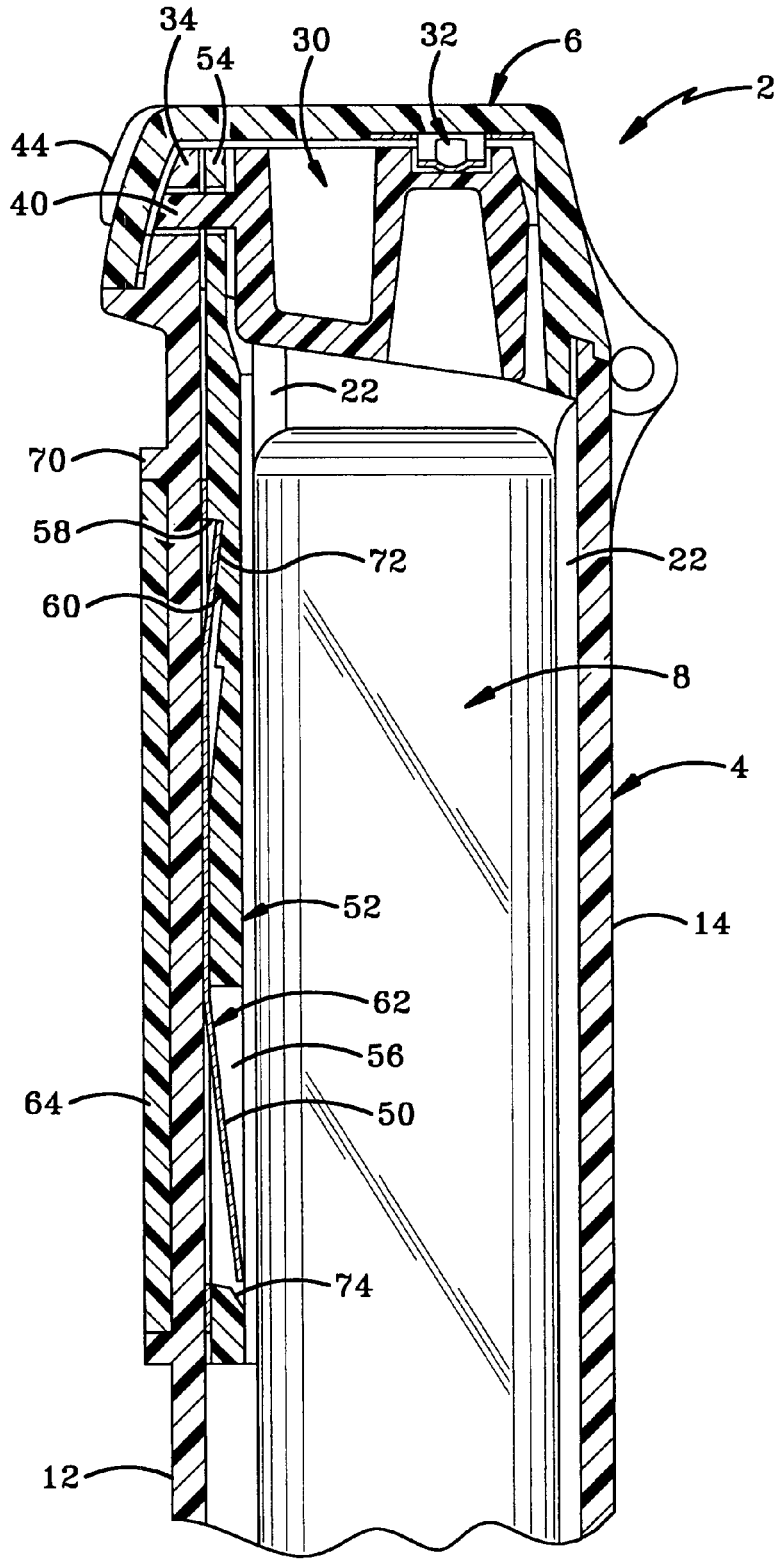
FIG. 12 is a section view taken along line 12-12 of FIG. 10.
Figure 15:
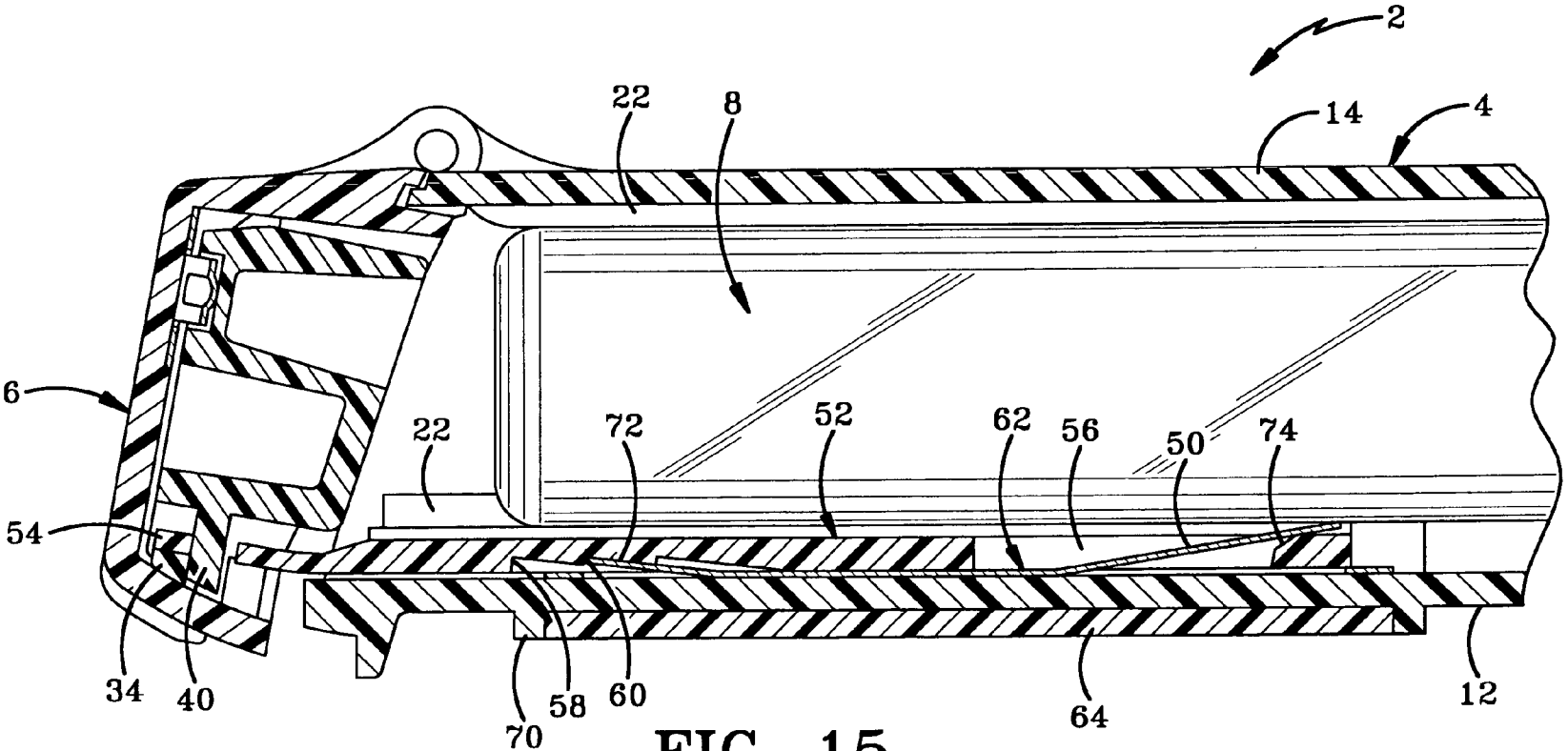
FIG. 15 is a section view similar to FIG. 13 showing the lid being moved from the closed position to the open position after the lock tabs of the base have been broken.

In the exemplary embodiment of the invention, locking member 52 is in the form of a cover plate that extends across a substantial amount of the width of base 4. Cover plate 52 includes four lock tabs 54 as shown in FIG. 4. Cover plate 52 is disposed adjacent the inner surface of front wall 12 as shown in FIGS. 11 and 12. Cover plate 52 moves between the inactivated position of FIGS. 11 and 12 to the activated position of FIGS. 15-21. Cover plate 52 defines an opening 56 for each prong 50. Opening 56 is adapted to receive a portion of prong 50 when cover plate 52 is in the inactivated position as shown in FIG. 12. Opening 56 allows prong 50 to extend through cover plate 52 when cover plate 52 is in the activated position such that prong 50 may engage item 8 as shown in FIG. 15. Cover plate 52 also defines at least first 58 and second 60 ledges that are used to properly position cover plate 52 with respect to base 4 and prong 50.

Prong 50 is fixed with respect to base 4. As such, prong 50 does not move with cover plate 52. Prong 50 is, however, biased toward its activated position and is held in its inactivated position by cover plate 52. Prongs 50 will be held for a majority of their life in the inactivated position. Because of this fact, prongs 50 are fabricated from a material, such as spring steel, that does not lose its resiliency over time.

In the exemplary embodiment of the invention, prong 50 extends from a prong plate 62. Prong plate 62 is secured to front wall 12 of base 4 in an appropriate manner. One appropriate manner of securing prong plate 62 is to use a holding plate 64 on the outside of front wall 12 with feet 66 that extend through front wall 12 to engage openings 68 defined by prong plate 62 in a snap fit connection. The innermost ends of feet 66 may be flattened against plate 62 to provide a secure connection. Plate 52 may define openings 71 that accommodate feet 66. A perimeter wall 70 may be connected to front wall 12 to prevent one from prying holding plate 64 away from front wall 12. Prong plate 62 may also be received in a pocket formed on the interior surface of wall 12 or secured to the interior surface of wall 12 with an appropriate adhesive or with appropriate mechanical connectors such as rivets, screws, and the like.

Prong plate 62 includes a generally planar base plate from which prong 50 extends in a cantilevered fashion. The base plate of prong plate 62 defines an opening that receives prong 50 when prong 50 is compressed to its inactivated position. In the exemplary embodiment of the invention, prong plate 62 includes four prongs 50. Each prong 50 includes a sharp razor-like tip that is adapted to tear into item 8 and at least deface item 8. Prong plate 62 further includes at least one stop 72 that prevents cover plate 52 from moving from its activated position to its inactivated position. In the exemplary embodiment, prong plate 62 includes four stops 72 that are positioned to engage first and second ledges 58, 60.

Figure 10:
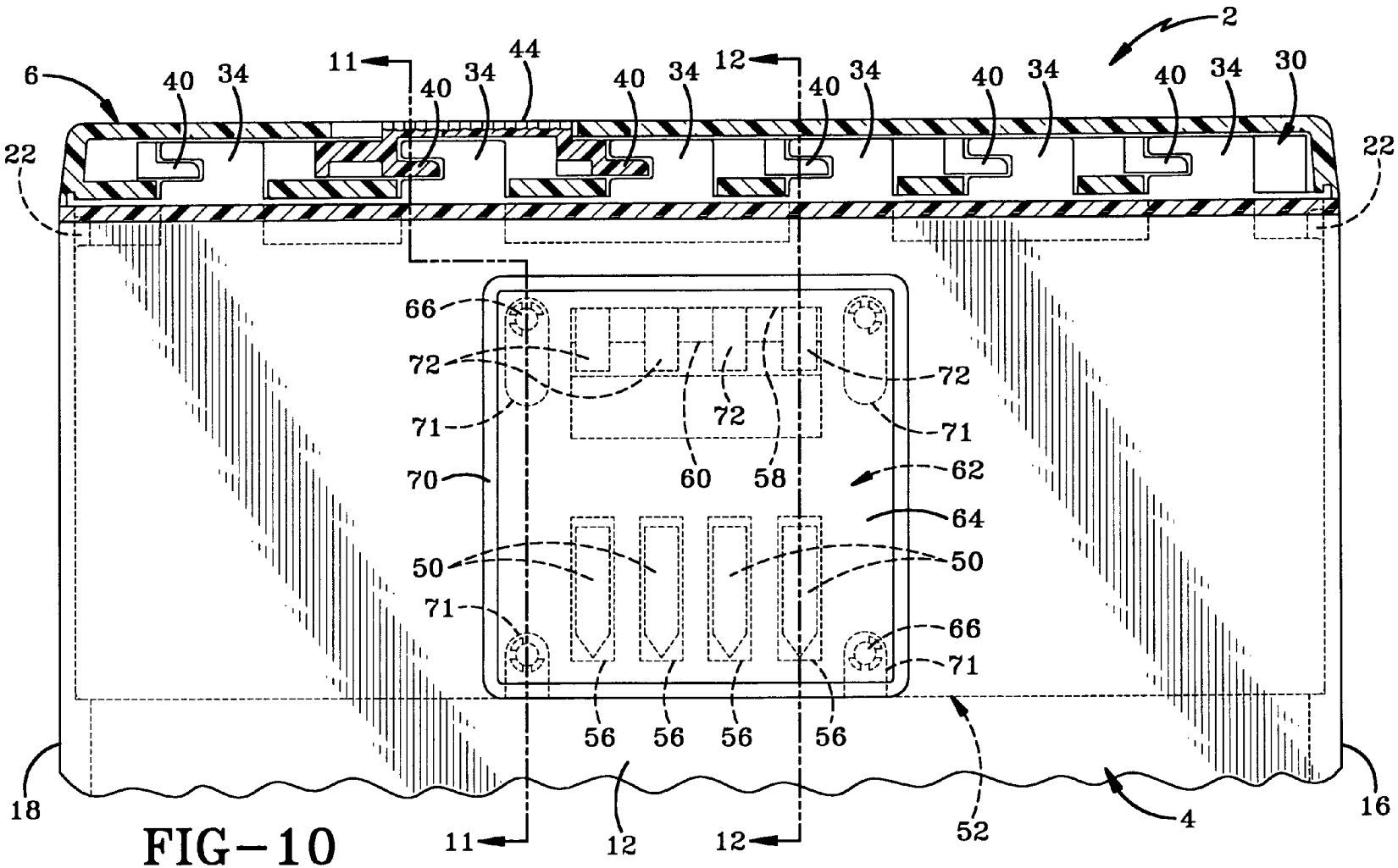
FIG. 10 is a view similar to FIG. 6 showing the four lock tabs of the secondary security feature locked with the lock tabs of the lid.

FIGS. 10, 11, and 12 show the relative positions of base 4, cover plate 52, and prong plate 62. FIG. 11 shows the manner in which cover plate 52 is held in place to trap prong plate 62 with prongs 50 in the inactivated position. FIG. 12 shows the inactivated positions of prongs 50 with stop 72 engaging first ledge 58. In FIGS. 10-12, lock tabs 54 of cover plate 52 are in the locked position and engage lock tabs 40 on lock slide 30. Cover plate 52 may be fabricated from a material that is different from the material of base 4 and lid 6 so that lock tabs 54 do not fracture or break if lock tabs 34 and 40 fracture and break. For instance, cover plate 52 may be fabricated from a thin metal material that will not fracture when struck against object 46.

Figure 30:
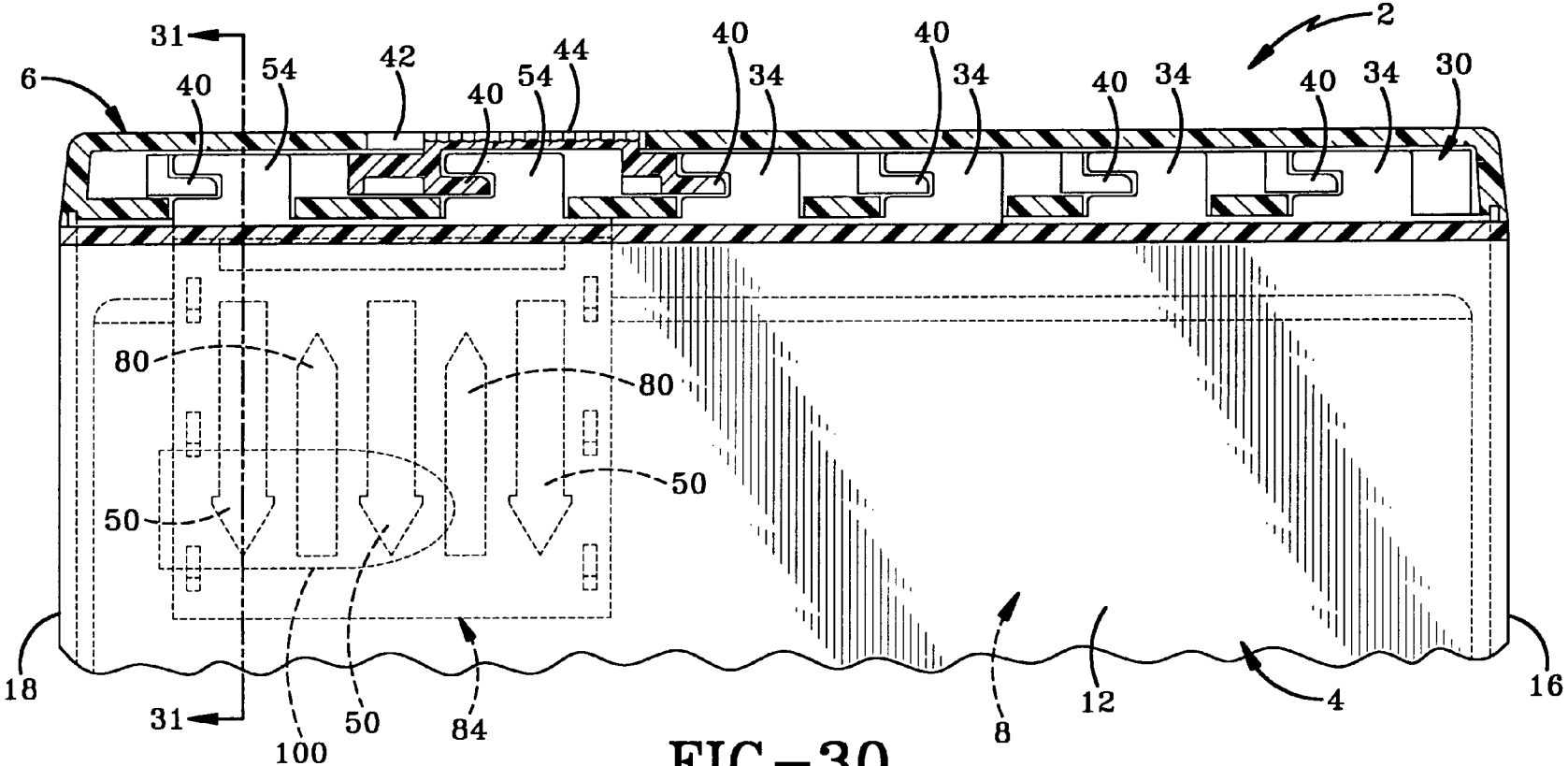
FIG. 30 is a front view, partially in section, showing the alignment of the secondary security feature with a recess defined by the item of merchandise disposed within the security storage container.
Figure 31:
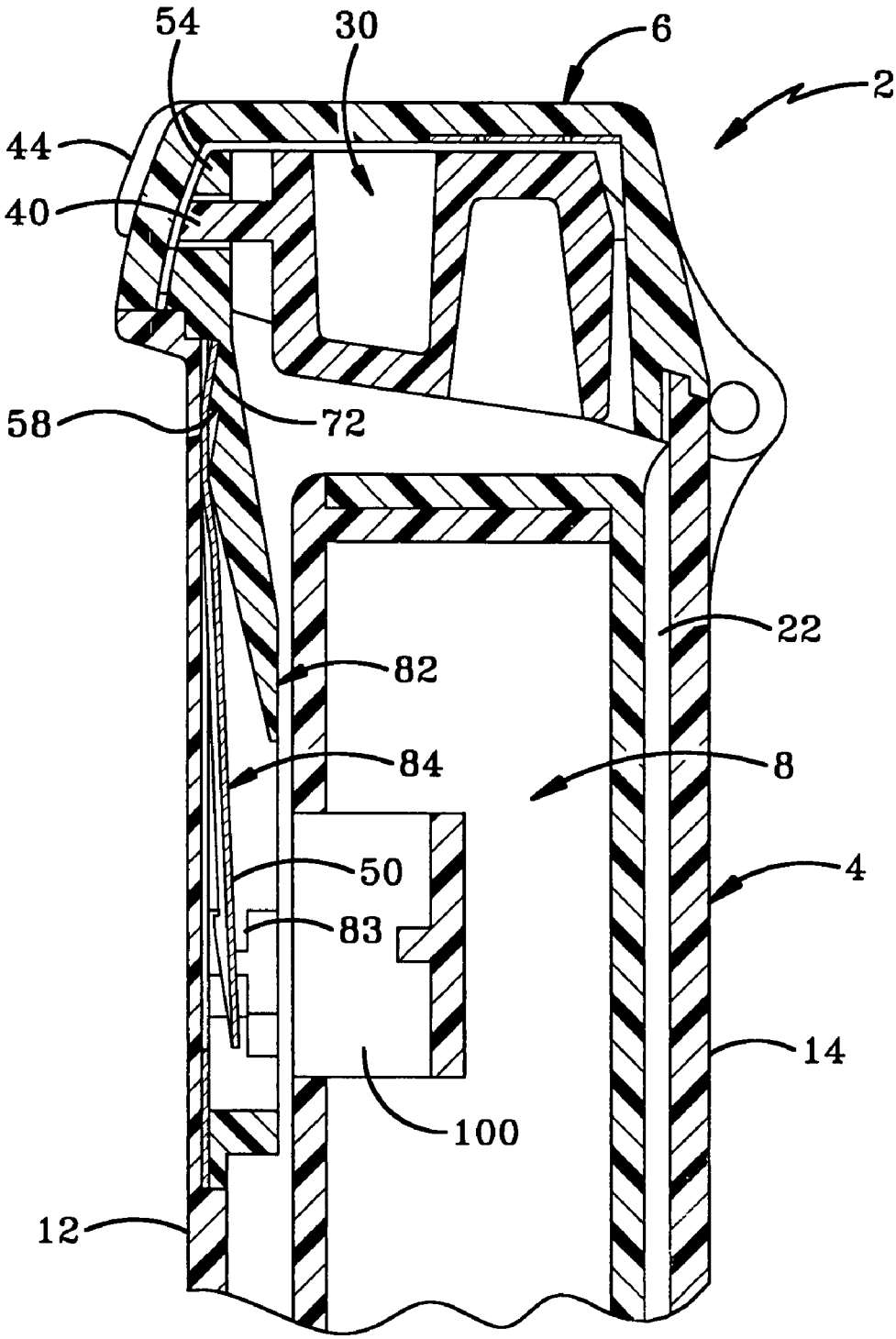
FIG. 31 is a section view taken along line 31-31 of FIG. 30.
Figure 32:
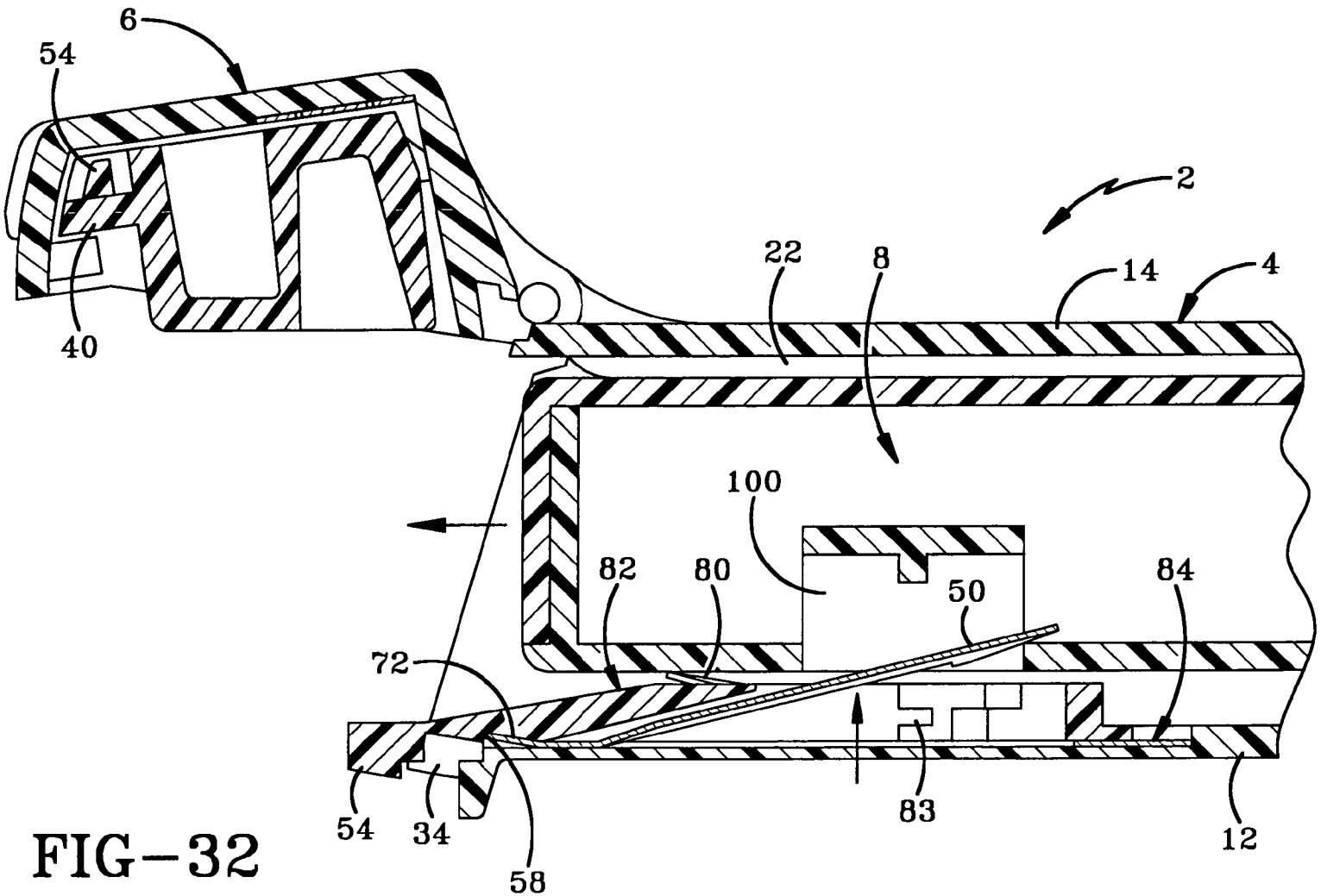
FIG. 32 is a view similar to FIG. 31 showing the activated position of the secondary security feature with the item of merchandise being removed from the container.
Figure 33:
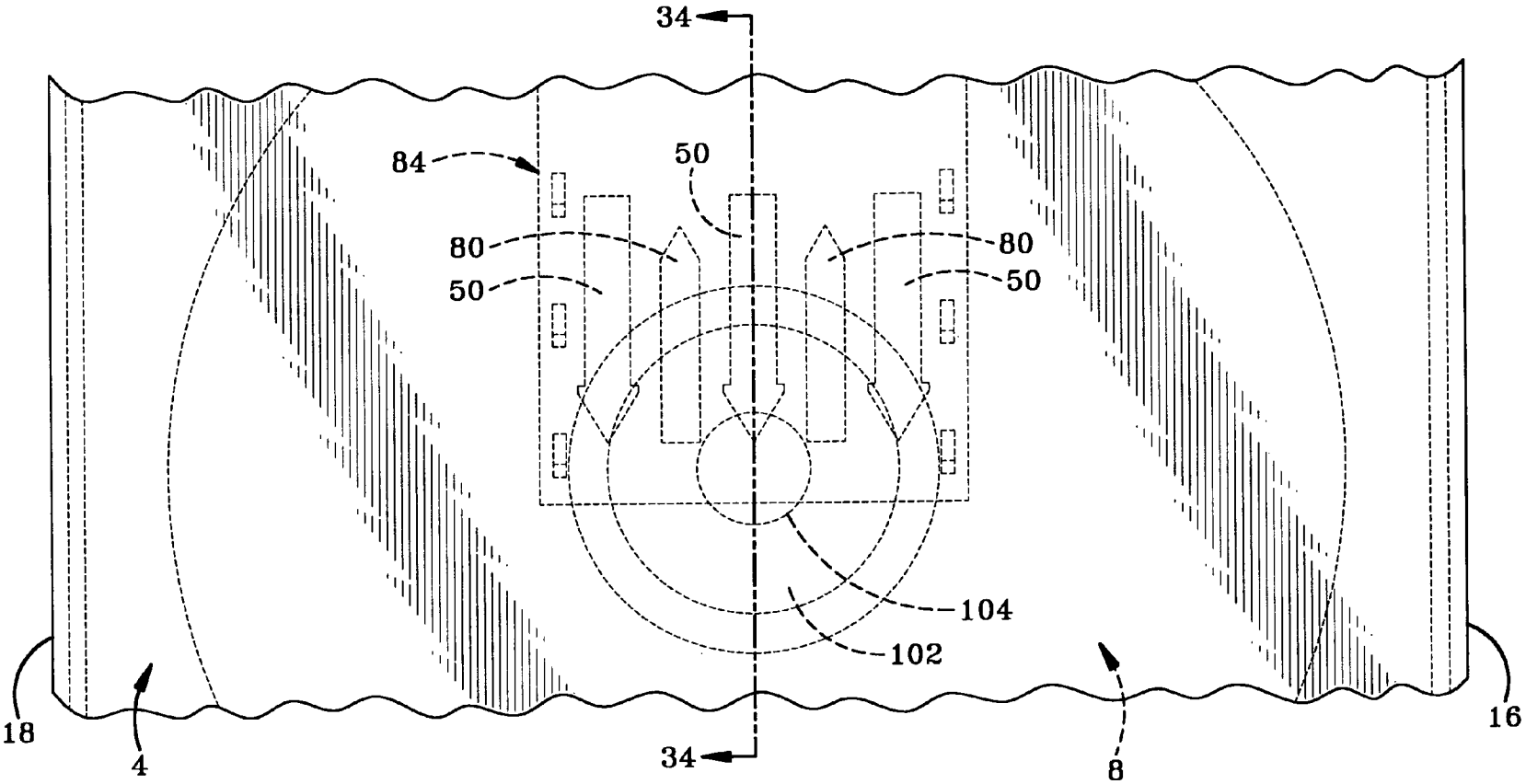
FIG. 33 is a front elevation view showing the secondary security feature aligned with a different recess formed in the item of merchandise disposed within the security storage container.
Figure 34:
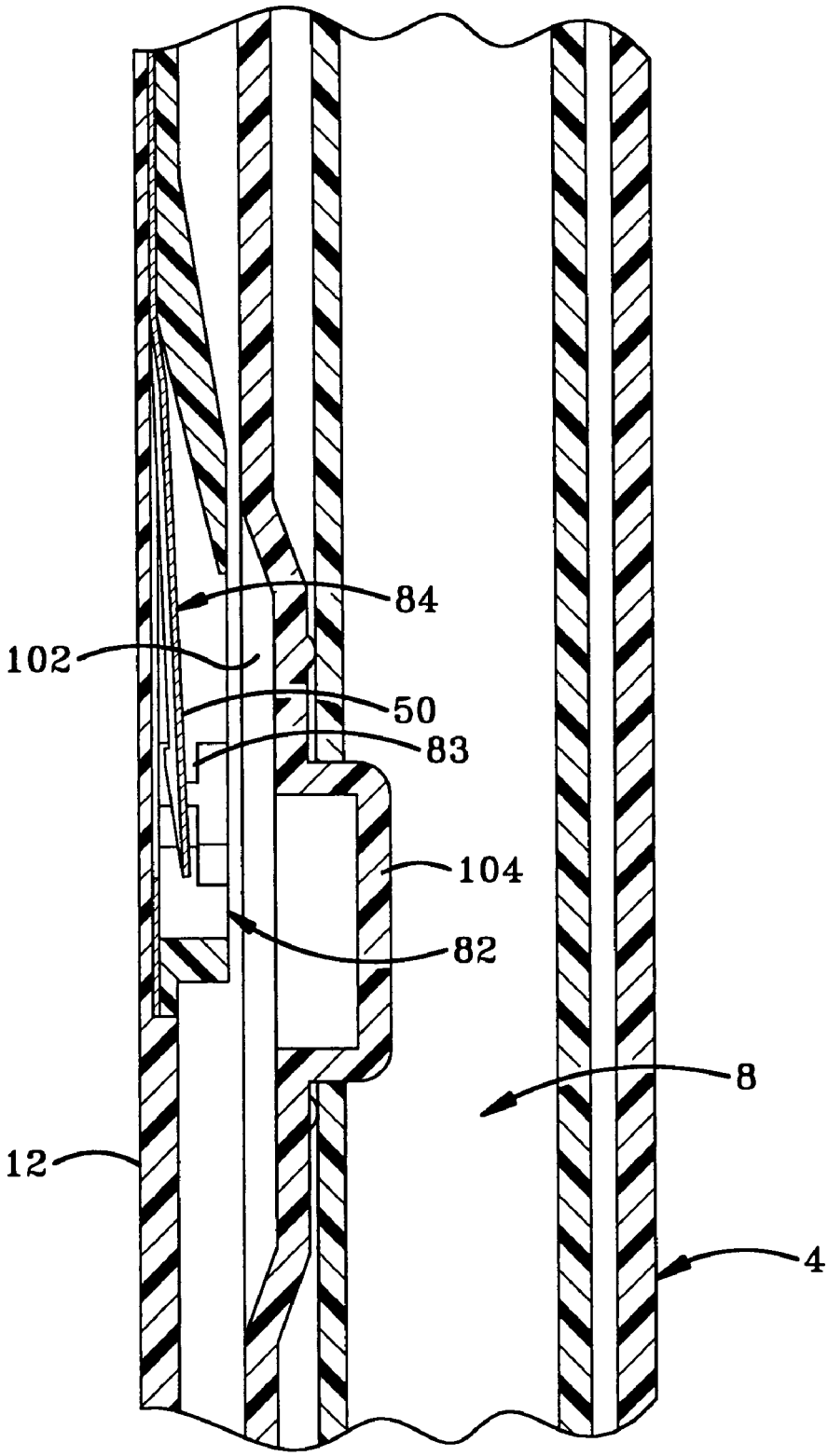
FIG. 34 is a section view taken along line 34-34 of FIG. 33.
Figure 35:
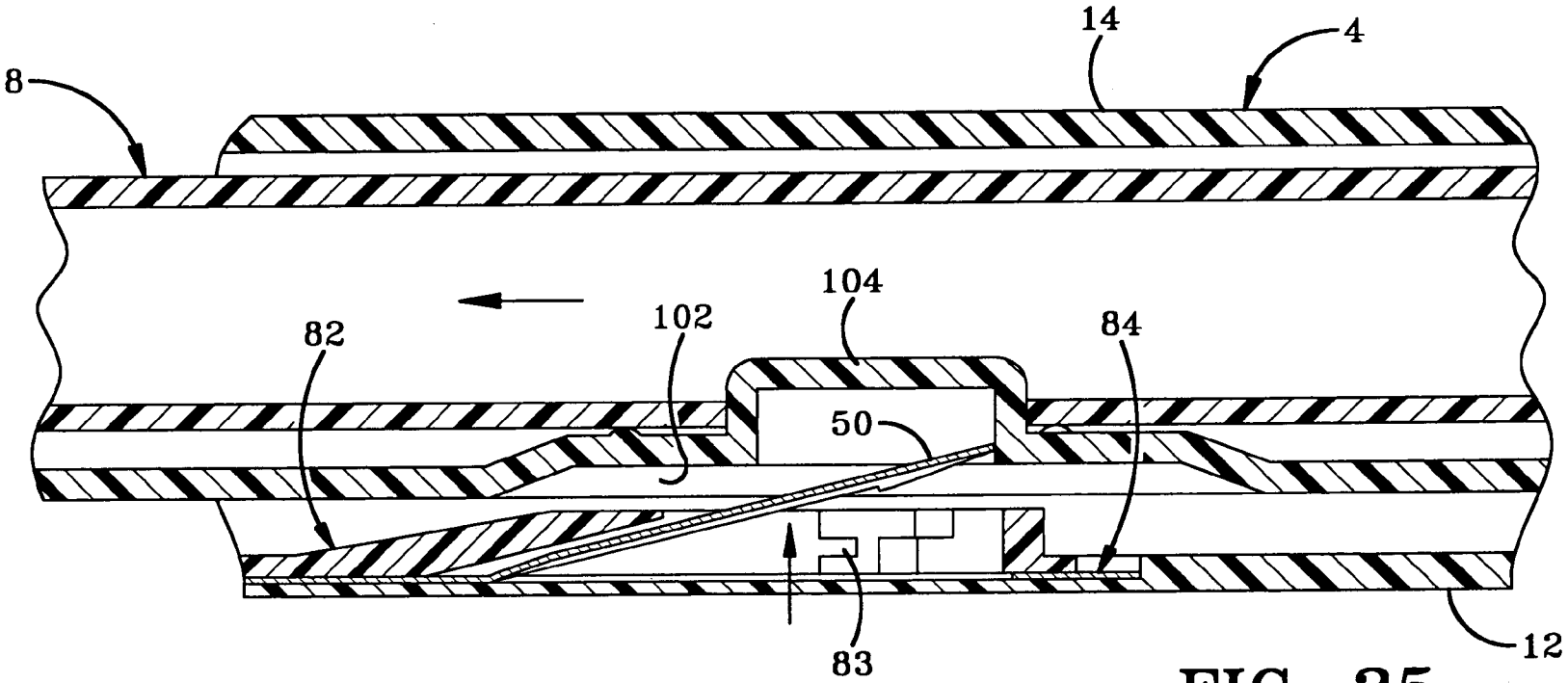
FIG. 35 if a view similar to FIG. 34 showing the activated position of the secondary security feature with the item of merchandise being removed from the container.
Figure 36:
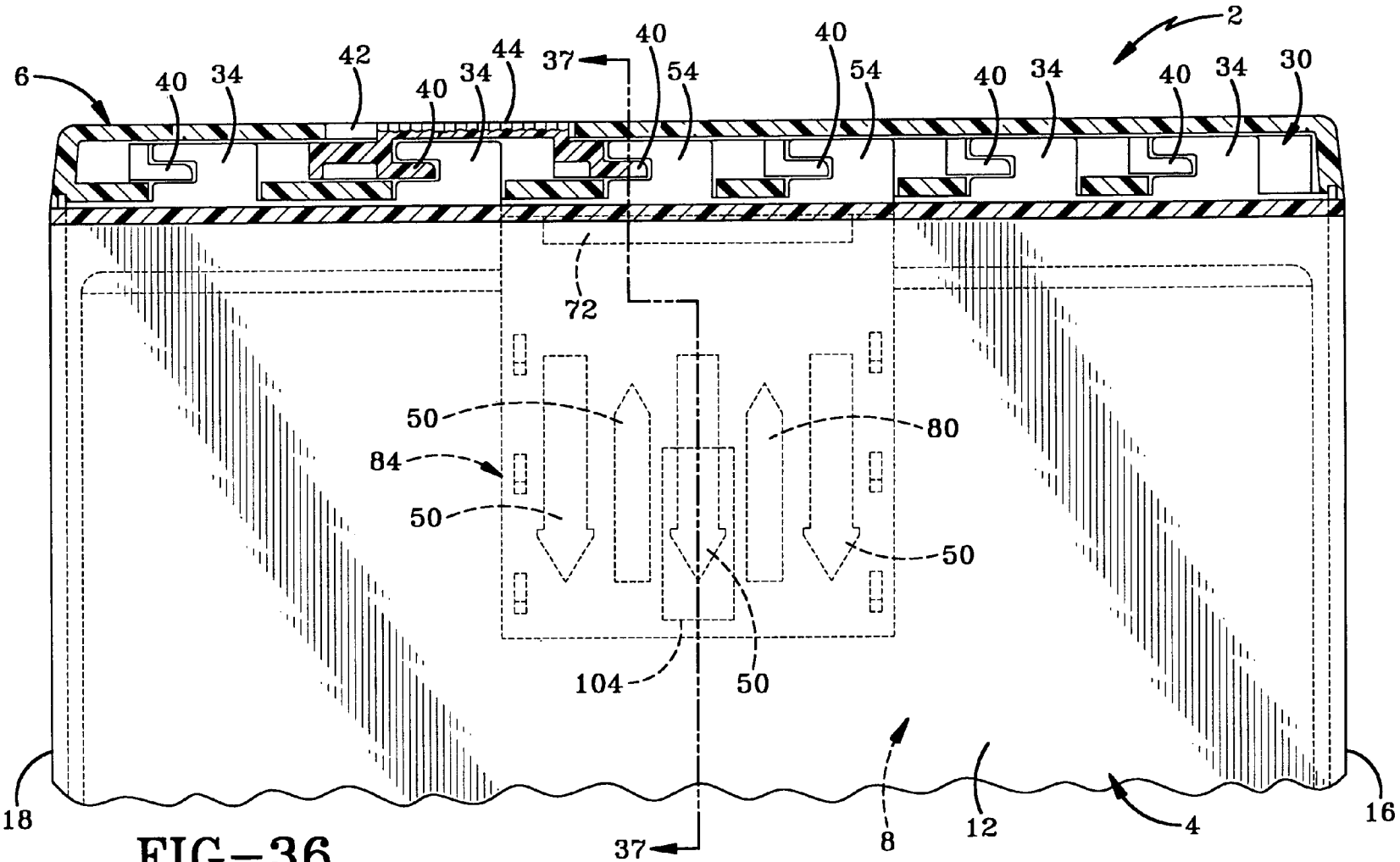
FIG. 36 is a front elevation view showing the secondary security feature aligned with an opening defined by the item of merchandise disposed within the security storage container.
Figure 37:
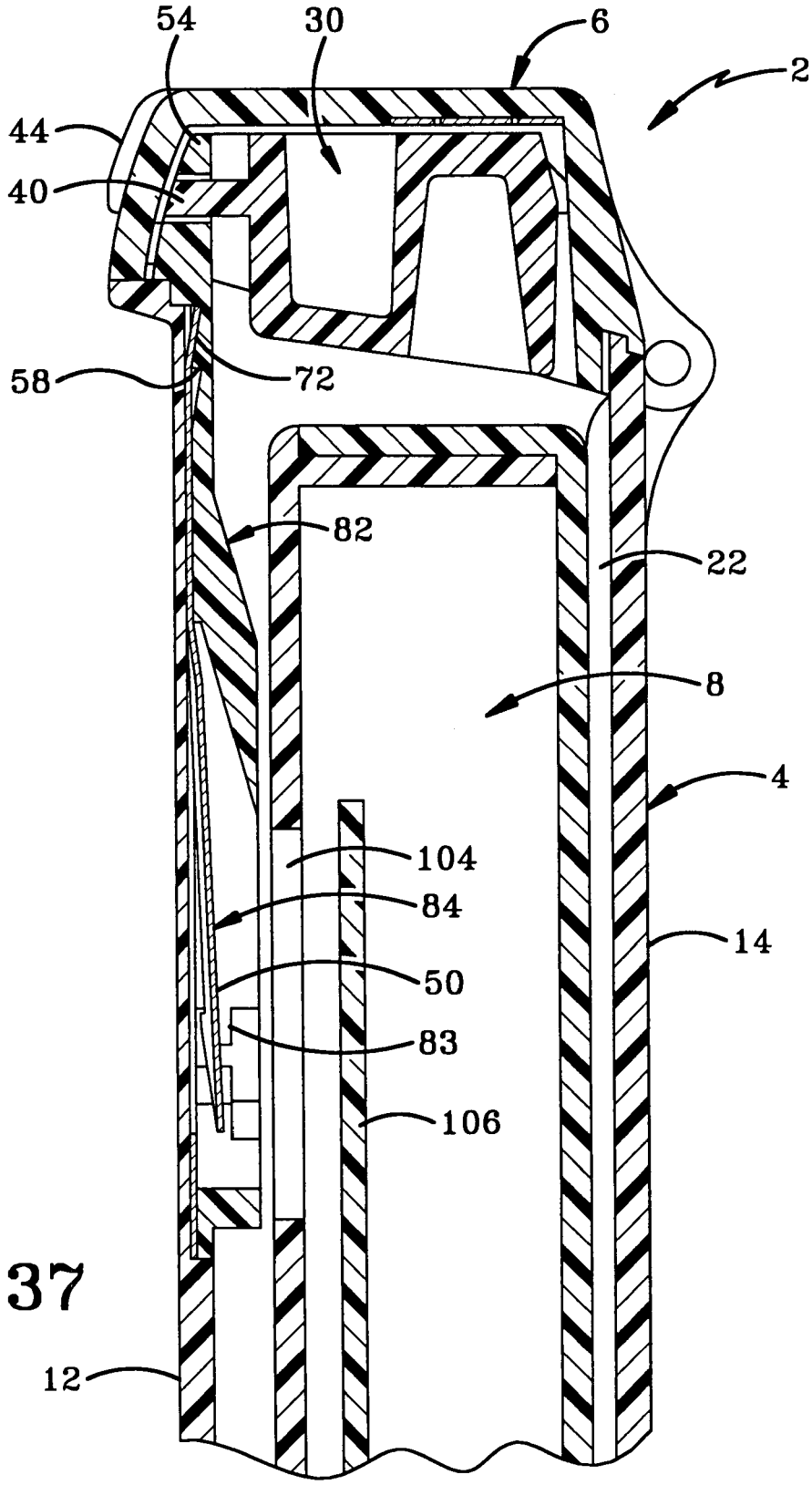
FIG. 37 is a section view taken along line 37-37 of FIG. 36.
Figure 38:
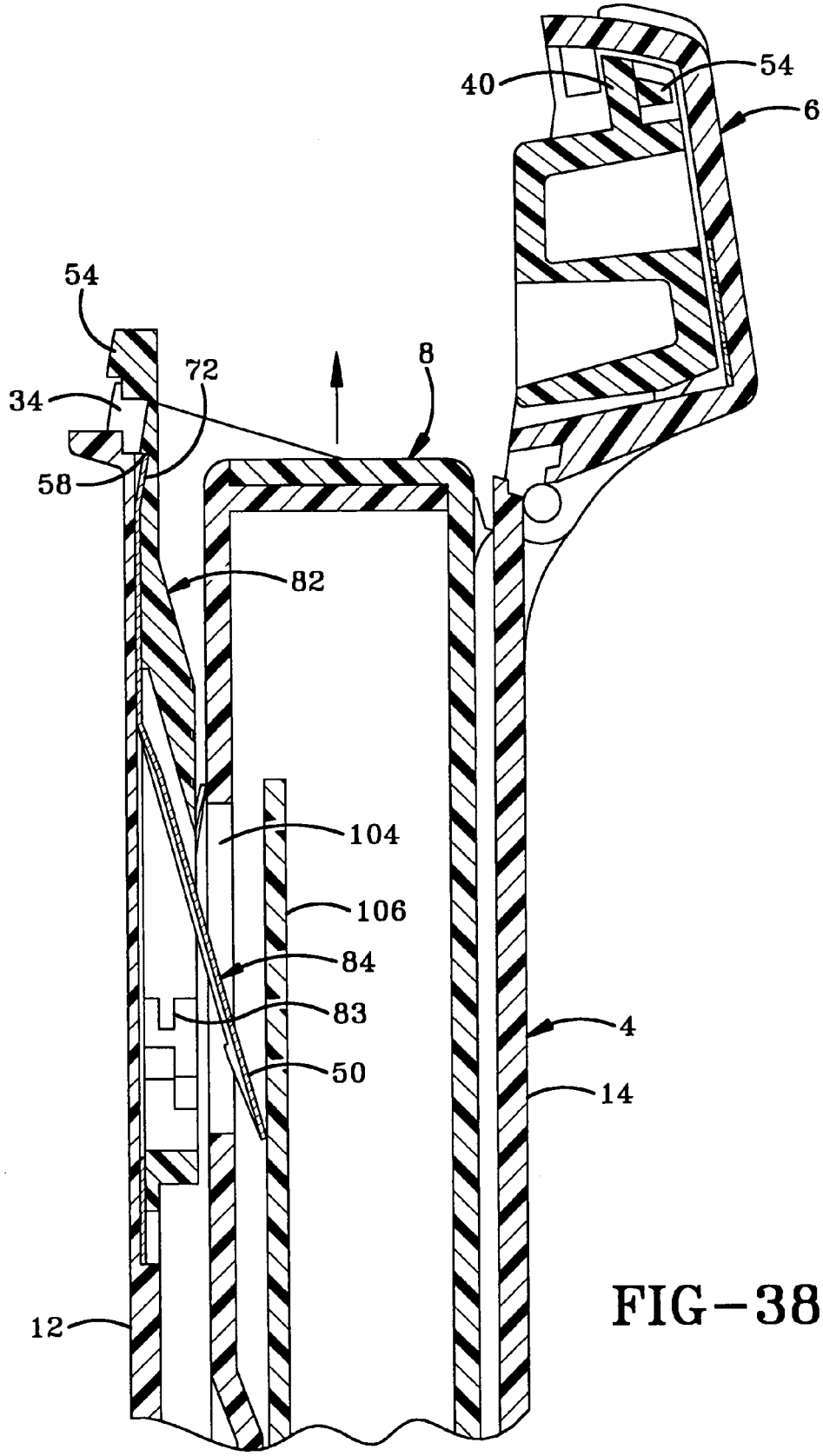
FIG. 38 if a view similar to FIG. 36 showing the activated position of the secondary security feature with the item of merchandise being removed from the container.

Security storage container 2 is provided to the user with the secondary security feature in its inactivated position as shown in FIG. 10. The user opens lid 6 by unlocking the primary security feature. In this example, the user aligns key 36 with locking mechanism 32 and moves lock slide 30 to its unlocked position. The user then opens lid 6 and places item 8 inside base 4. In some situations, the user may wish to align a feature of item 8 with the secondary security feature so that the activation of the secondary security feature will cooperate with a feature on item 8. Exemplary features are shown in FIGS. 30-38. In FIGS. 30-38, item 8 is a media storage container that has openings 100 that are formed when literature clips are molded into item 8. Openings 100 are depicted in FIGS. 30-32. In the embodiment of the invention depicted in FIGS. 30-32, prongs 50 are positioned on base 4 to be aligned with opening 100 when item 8 is properly inserted into base 4. Opening 100 is thus a feature on item 8 that can be used in cooperation with the secondary security feature. Another feature on item 8 is shown in FIGS. 33-35. This feature is the concave opening 102 defined by the rear surface of item 8 where a disc hub 104 is formed. Concave opening 102 may be aligned with prongs 50 so that prongs 50 will cooperate with openings 102 when prongs 50 are activated as shown in FIG. 35. FIGS. 36-38 show a further secondary security feature wherein an opening 104 is formed in a wall of item 8 so that prong 50 will engage the merchandise inside item 8 as well as lock item 8 in place. When item 8 is a disc storage container, prong 50 will directly engage and damage the disc 106 as shown in FIG. 38. Destruction of disc 106 prevents the shoplifter from profiting from the theft.

After the user inserts item 8 into base 4, the user closes lid 6 and moves lock slide 30 to the locked position. Locking mechanism 32 will automatically move to the locked position to securely lock item 8 within container 2.

When the user unlocks locking mechanism 32 and moves lock slide 30 to the unlocked position, cover plate 52 is not disturbed and remains in its inactivated position and the secondary security feature is not activated. The secondary security feature thus does not interfere with the proper use of security device 2.

Figure 14:
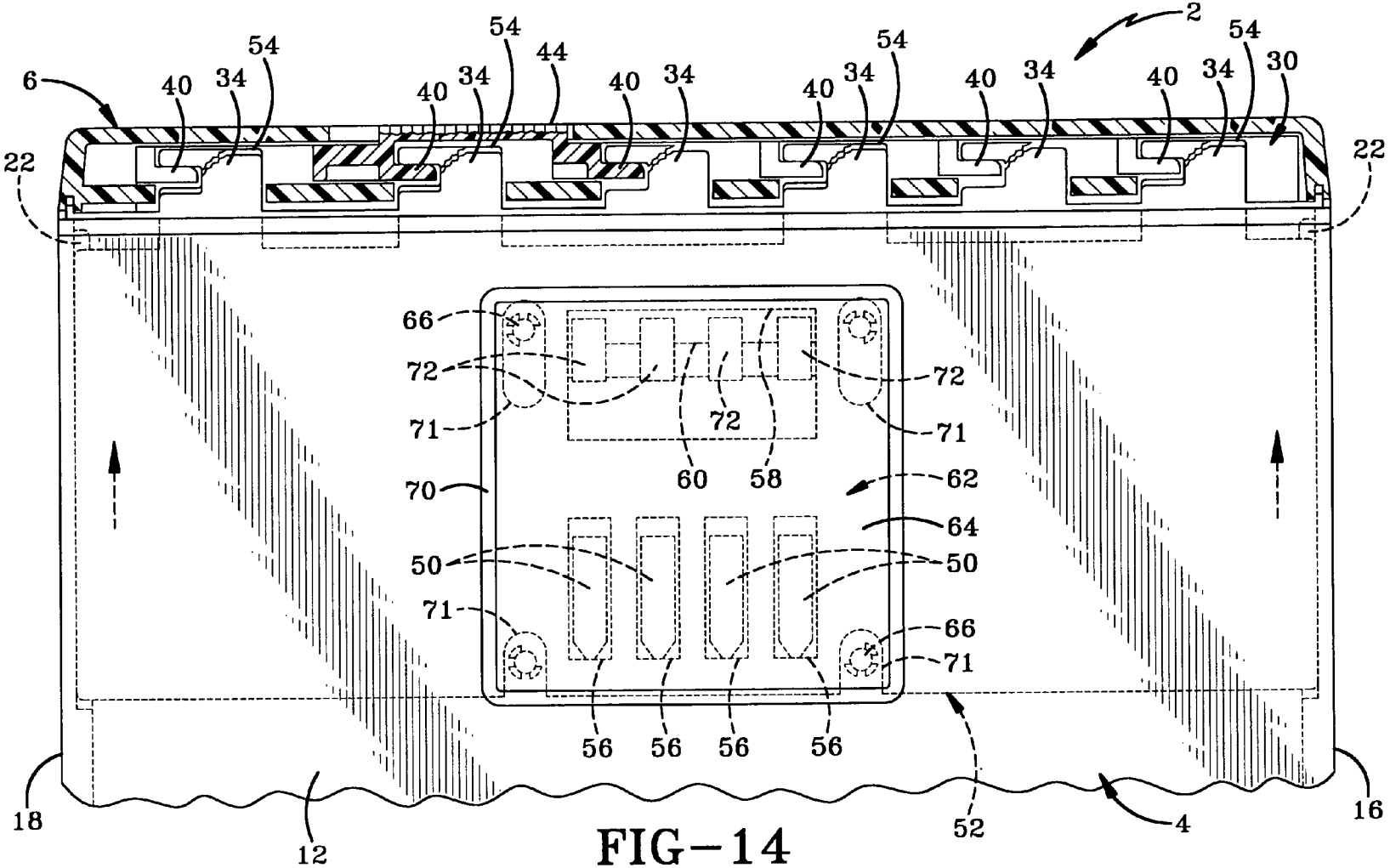
FIG. 14 is a view similar to FIG. 6 showing the lock tabs of the base broken.
Figure 16:
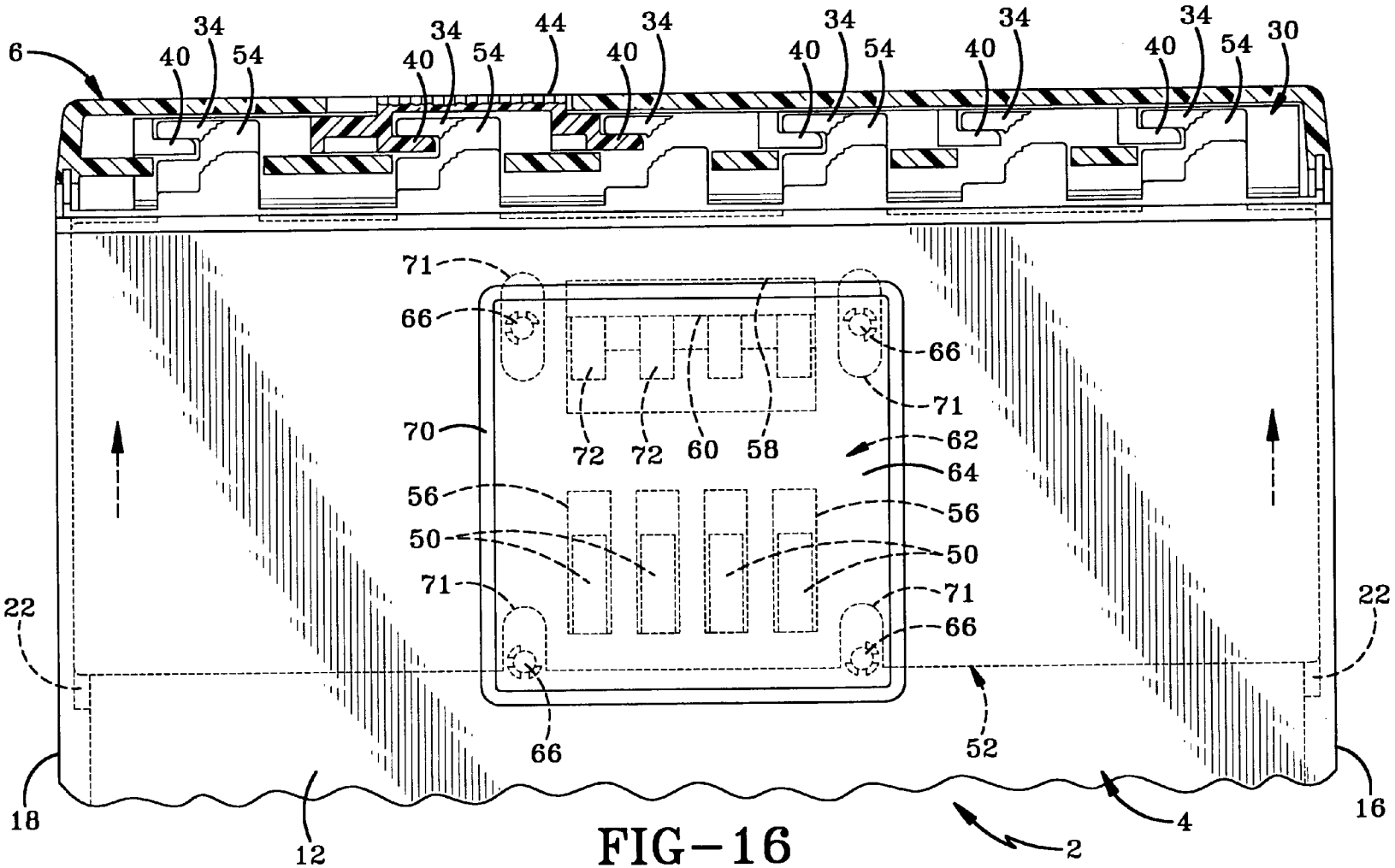
FIG. 16 is a view similar to FIG. 10 showing the activated position of the secondary security feature.
Figure 17:
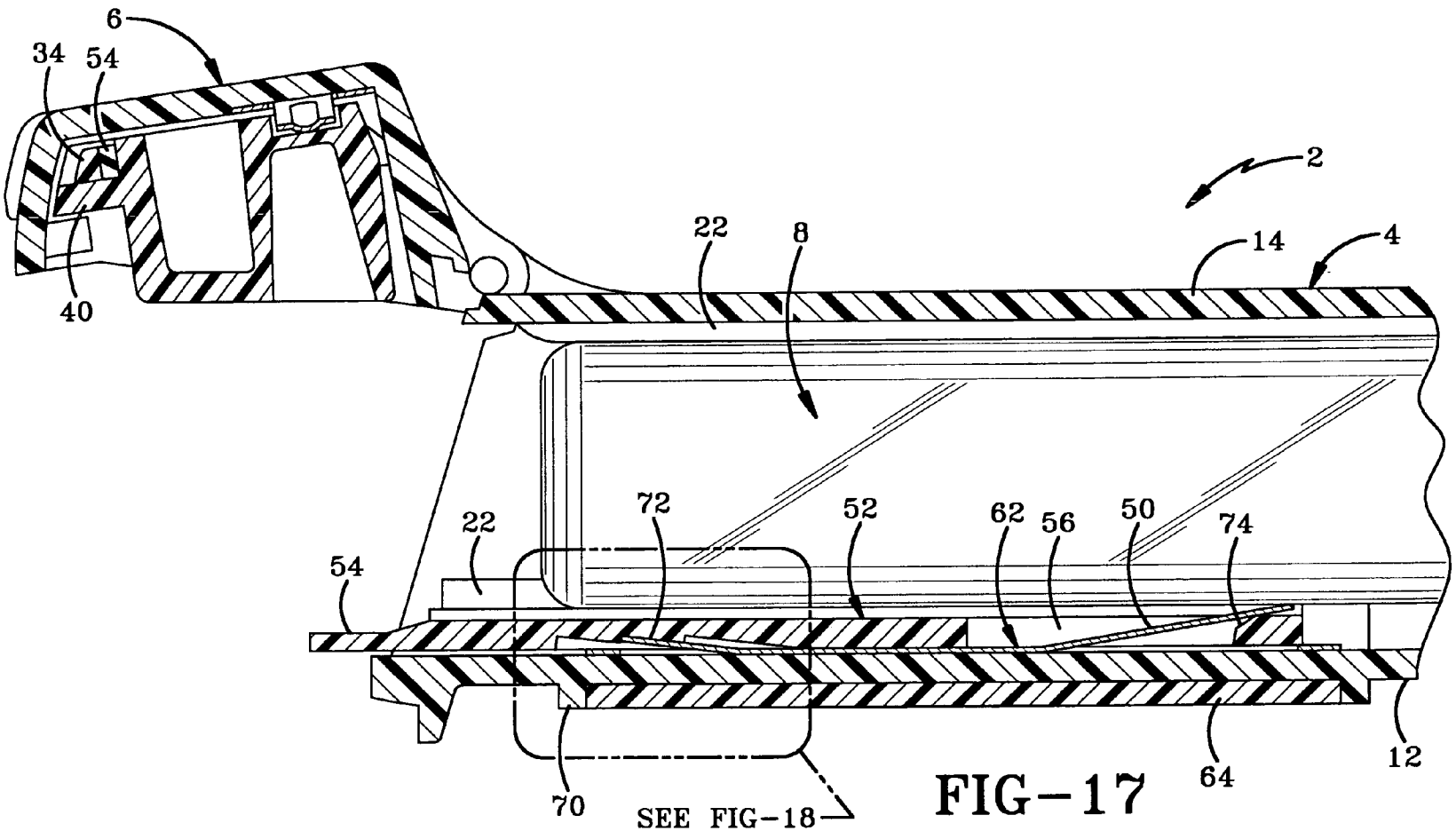
FIG. 17 is a view similar to FIG. 15 showing the lid entirely open with the secondary security feature activated.
Figure 18:
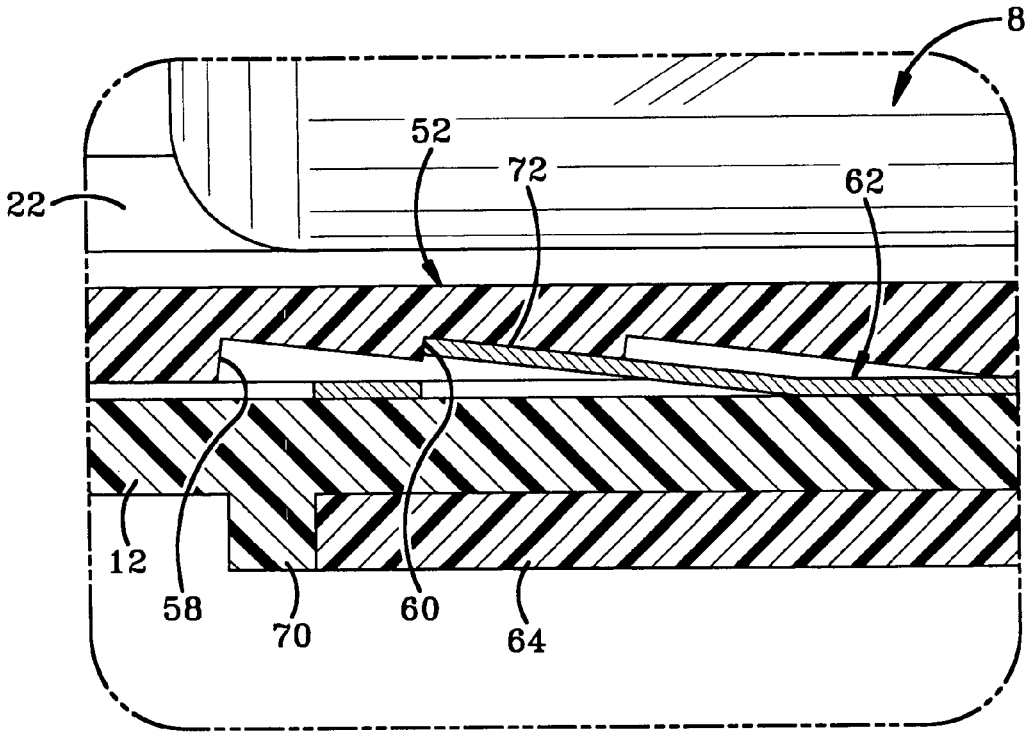
FIG. 18 is an enlarged section view of the encircled portion of FIG. 17.
Figure 20:
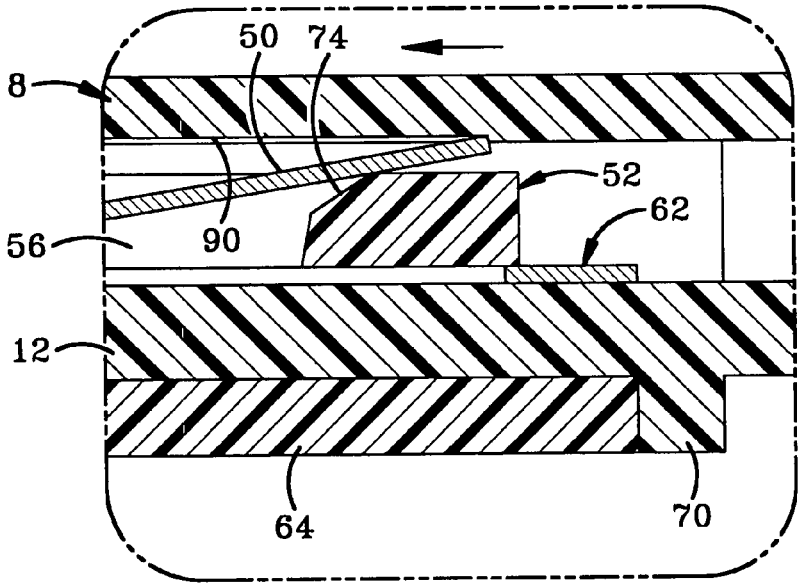
FIG. 20 is an enlarged section view of the encircled portion of FIG. 19.
Figure 19:
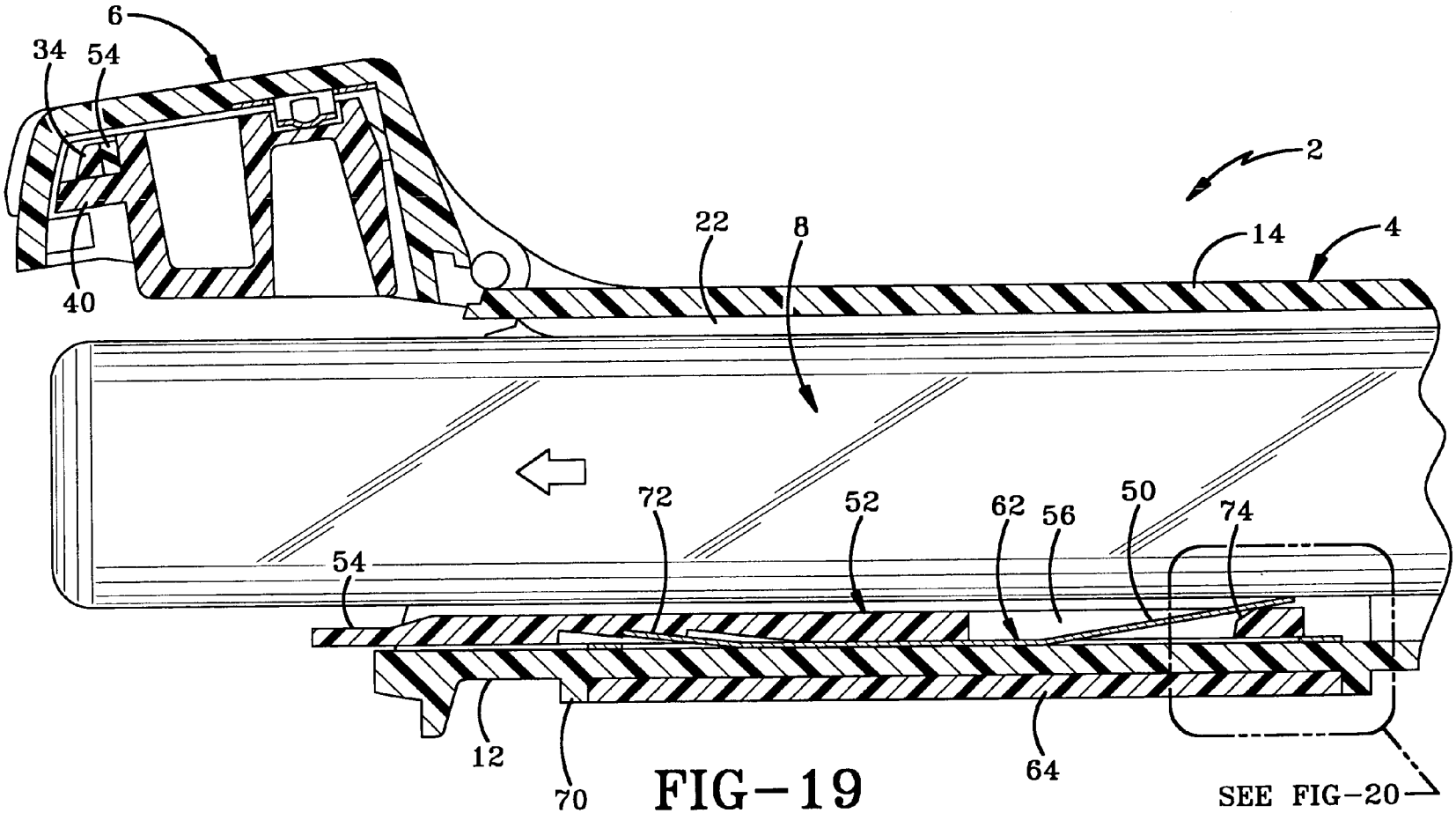
FIG. 19 is a view similar to FIG. 17 showing the item of merchandise being removed from the security storage container with the secondary security feature activated.
Figure 21:
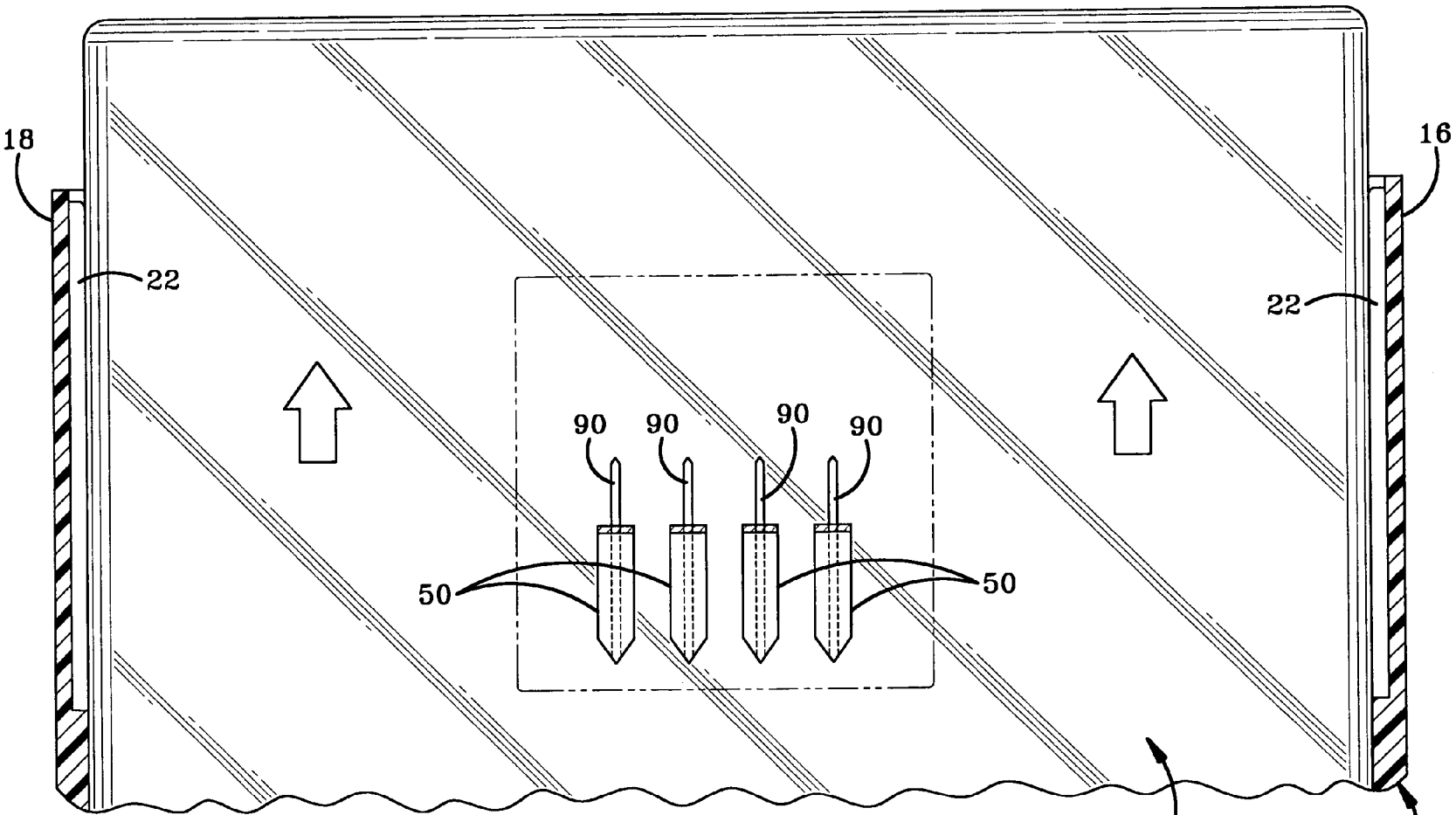
FIG. 21 is a section view showing the secondary security feature engaging and damaging the item of merchandise.

If, however, a shoplifter attempts to open security storage container 2 by destroying lock tabs 34 and 40, the secondary security feature will be activated. FIG. 13 shows device 2 being struck against object 46 in an attempt to break lock tabs 34 and 40. FIG. 13A shows the use of pry bar 48 to break open lid 6. FIG. 14 shows the successful fracture of lock tabs 34 that are connected to base 4. FIG. 14 also shows that lock tabs 54 on cover plate 52 are not fractured. After a shoplifter has broken tabs 34 in FIG. 14, the shoplifter opens lid 6 as shown in FIG. 15 in order to remove item 8. When this occurs, lock tabs 54 remain engage with lock tabs 40 of lock slide 30 and cover plate 52 is pulled from its inactivated position toward its activated position as shown in FIGS. 15-17. In FIG. 17, lock tabs 54 have slipped off of lock tabs 40 or have been bent by the force of lid 6 being opened. Regardless of the damage to lock tabs 54, prongs 50 are now in the activated position and locked in place by the interaction between stops 72 and second ledge 60 as shown in FIGS. 17 and 18. In their activated position, prongs 50 are disposed against item 8 where they will tear or otherwise disfigure or damage item 8 if the shoplifter pulls item 8 from base 4. In the situations where prongs 50 are aligned with an indented feature of item 8 such as opening 100 (FIG. 30), concave opening 102 (FIG. 33), or opening 104 (FIG. 35), the activated position of prongs 50 will lock prong 50 against item 8 to prevent item 8 from being withdrawn from base 4. The secondary security device thus frustrates the shoplifter by damaging the item being stolen or by preventing the item from being removed from base 4.

If the shoplifter pulls directly on cover plate 52 in an attempt to remove cover plate 52 from base 4, the lower end 74 of cover plate 52 will wedge under prongs 50 causing prongs 50 to push harder against item 8 as shown in FIGS. 15-21. The corner of lower end 74 may be angled to facilitate this wedging action.

An alternative embodiment of the invention is depicted in FIGS. 22-29 with many of the same reference numerals being used to identify similar components despite some changes in the structure or number of the components. Container 2 of FIGS. 22-29 functions in the same manner as described above and thus includes the primary and secondary security features that are linked together to frustrate shoplifters. In this embodiment, opposing prongs 80 are disposed intermediate prongs 50 and deploy in a different direction to further engage item 8.

In this embodiment, the cover plate 82 is slidably carried adjacent the inner surface of front wall 12 in a pocket formed by ribs projecting from wall 12. Prong plate 84 is secured between cover plate 80 and front wall 12. Prongs 50 and 80 are cantilevered from prong plate 84. Prong plate 84 also includes stop 72 that engages ledge 58 when plate 82 is pulled out to the activated position. Cover plate 82 includes a retaining ledge 83 for each prong 50 and 80 that holds prong 50/80 in the inactivated position.

This embodiment of the invention is used in the same manner described above. If the primary security feature of lid 6 is defeated by force and the shoplifter opens lid 6, lock tabs 54 remain engaged with lock tabs 40 lock slide 30 and pull cover plate 82 to the activated position. In this position, prongs 50 and 80 engage item 8 and damage item 8 as shown at numeral 90 in FIGS. 26 and 28.

In the foregoing description, certain terms have been used for brevity, clearness, and understanding. No unnecessary limitations are to be implied therefrom beyond the requirement of the prior art because such terms are used for descriptive purposes and are intended to be broadly construed.

Moreover, the description and illustration of the invention is an example and the invention is not limited to the exact details shown or described.

The invention claimed is:

1. An apparatus comprising:

a frame;

an interior chamber formed in the frame adapted to receive an item of merchandise;

a first security feature for preventing removal of the item of merchandise from the frame;

a second security feature comprising a solid item-engaging member in the interior chamber for damaging the item of merchandise upon defeat of the first security feature;

a lid mounted on the frame and movable between open and closed positions;

a lock slide of the first security feature which is slidable between an unlocked position and a locked position to selectively lock the lid to the frame in the closed position to prevent removal of the item of merchandise from the frame;

an opening formed through the lid;

a finger tab which is an integral part of the lock slide and moves therewith, and which is manually engageable via the opening when the lid is in the closed position; and a locking member movable between a first position which allows the lock slide with its finger tab to slide between the unlocked and locked positions and a second position which secures the lock slide with its finger tab in the locked position;

a first lock tab rigidly mounted on the frame;

a second lock tab movably mounted on the frame adjacent and aligned with the first lock tab;

a third lock tab on the lock slide; and wherein the third lock tab engages the first lock tab in the locked position to lock the lid to the frame in the closed position and is disengaged from the first lock tab in the unlocked position to allow the lid to move from the closed position to the open position;

and upon fracture of the first lock tab, the third lock tab engages the second lock tab to prevent the lid from moving to the open position.

2. The apparatus of claim 1 wherein the frame comprises a sidewall bounding the interior chamber; the solid item-engaging member is mounted on the sidewall and movable upon defeat of the first security feature from an inactivated position adapted to be out of contact with the item of merchandise in a direction away from the sidewall to an activated position adapted to engage the item of merchandise to damage it.

3. The apparatus of claim 1 in combination with the item of merchandise; and wherein the solid item-engaging member engages the item of merchandise to damage it upon defeat of the first security feature.

4. The apparatus of claim 1 wherein the item-engaging member is movable between from an inactivated position adapted to be out of contact with the item of merchandise and an activated position adapted to engage the item of merchandise to damage it.

5. An apparatus comprising:

a frame;

an interior chamber formed in the frame adapted to receive an item of merchandise;

a first security feature for preventing removal of the item of merchandise from the frame;

a second security feature comprising a solid item-engaging member in the interior chamber for damaging the item of merchandise upon defeat of the first security feature; and a sharp tip on the solid item-engaging member adapted to tear into the item of merchandise.

6. The apparatus of claim 5 further comprising a sidewall on the frame bounding the interior chamber; and a plurality of ribs on the frame which are secured to the sidewall and extend inwardly therefrom into the interior chamber, which are fixed relative to the sidewall, and which are adapted to force the item of merchandise against the item-engaging member; and wherein the first security feature comprises a lid which is mounted on the frame and movable relative to the frame and ribs between a closed position for preventing removal of the item of merchandise from the frame and an open position for allowing removal of the item of merchandise from the frame.

7. The apparatus of claim 5 further comprising a lid mounted on the frame and movable between open and closed positions; a lock slide of the first security feature which is slidable between an unlocked position and a locked position to selectively lock the lid to the frame in the closed position to prevent removal of the item of merchandise from the frame; an opening formed through the lid; and a finger tab which is an integral part of the lock slide and moves therewith, and which is manually engageable via the opening when the lid is in the closed position; and a locking member movable between a first position which allows the lock slide with its finger tab to slide between the unlocked and locked positions and a second position which secures the lock slide with its finger tab in the locked position.

8. The apparatus of claim 6 in combination with the item of merchandise; and wherein the ribs engage the item of merchandise when the lid is in the open position.

9. An apparatus comprising:

a frame;

an interior chamber formed in the frame adapted to receive an item of merchandise;

a first security feature for preventing removal of the item of merchandise from the frame;

a second security feature comprising a solid item-engaging member in the interior chamber for damaging the item of merchandise upon defeat of the first security feature; and wherein the item-engaging member comprises a cantilevered first prong which in the activated position is adapted to engage the item of merchandise to damage it.

10. The apparatus of claim 9 further comprising a cantilevered second prong which in the activated position is adapted to engage the item of merchandise to damage it; a free end on the first prong extending in a first direction; and a free end on the second prong extending in a second direction generally opposite the first direction.

11. An apparatus comprising:

a frame;

an interior chamber formed in the frame adapted to receive an item of merchandise;

a first security feature for preventing removal of the item of merchandise from the frame;

a second security feature comprising a solid item-engaging member in the interior chamber for damaging the item of merchandise upon defeat of the first security feature; wherein the item-engaging member is movable between from an inactivated position adapted to be out of contact with the item of merchandise and an activated position adapted to engage the item of merchandise to damage it; and a cover member in the interior chamber movable between an inactivated position in which the cover member blocks the item-engaging member from moving to its activated position and an activated position in which the cover member allows the item-engaging member to move to its activated position.

12. The apparatus of claim 11 further comprising an opening formed through the cover member; and wherein the item-engaging member moves through the opening between its activated and inactivated positions.

13. The apparatus of claim 11 further comprising a stop mounted on one of the frame and cover member for engaging the other of the frame and cover member to prevent the cover member from moving from its activated position to its inactivated position.

14. The apparatus of claim 11 wherein the cover member moves to its activated position only when a portion of the first security feature is fractured.

15. The apparatus of claim 11 further comprising a lid mounted on the frame and movable between a closed position and an open position; and wherein the cover member is linked to the lid to prevent the lid from moving to the open position upon defeat of the first security feature.

16. The apparatus of claim 15 further comprising a first locking member of the first security feature carried by the frame; and a second locking member of the first security feature carried by the lid and selectively lockably engageable with the first locking member to selectively lock the lid in the closed position; and wherein the cover member engages the second locking member to prevent the lid from moving to the open position upon defeat of the first security feature.

17. The apparatus of claim 16 further comprising a plurality of first lock tabs on the cover member; and a plurality of second lock tabs on the second locking member for respectively engaging the first lock tabs to prevent the lid from moving to the open position upon defeat of the first security feature.

18. The apparatus of claim 17 further comprising a plurality of third lock tabs on the first locking member for respectively engaging the second lock tabs to lock the lid in the closed position.

19. The apparatus of claim 11 wherein the cover member is a substantially flat plate.

20. The apparatus of claim 19 wherein the frame comprises a substantially flat sidewall bounding the interior chamber; and the plate is mounted on and parallel to the sidewall.

21. An apparatus comprising:

a frame;

an interior chamber formed in the frame adapted to receive an item of merchandise;

a first security feature for preventing removal of the item of merchandise from the frame;

a second security feature comprising a solid item-engaging member in the interior chamber for damaging the item of merchandise upon defeat of the first security feature; wherein the item-engaging member is movable between from an inactivated position adapted to be out of contact with the item of merchandise and an activated position adapted to engage the item of merchandise to damage it; and a cover member in the interior chamber movable between an inactivated position and an activated position in which the cover member engages the item-engaging member to force the item-engaging member toward its activated position.

22. An apparatus comprising:

a frame adapted to receive and display an item of merchandise;

an interior chamber formed in the frame;

a lid mounted on the frame and movable between open and closed positions; the lid having inner and outer surfaces; the inner surface defining an internal cavity;

a first security feature comprising a lock slide which is slidable between an unlocked position and a locked position to selectively lock the lid to the frame in the closed position to prevent removal of the item of merchandise from the interior chamber; wherein the lock slide is disposed within the internal cavity in the unlocked and locked positions;

a second security feature for damaging or preventing removal of the item of merchandise from the interior chamber upon defeat of the first security feature;

an opening formed through the lid from the inner surface to the outer surface and communicating with the internal cavity;

a finger tab which is an integral part of the lock slide and moves therewith, and which is manually engageable via the opening when the lid is in the closed position;

a locking member movable between a first position which allows the lock slide with its finger tab to slide between the unlocked and locked positions and a second position which secures the lock slide with its finger tab in the locked position;

a first lock tab rigidly mounted on the frame;

a second lock tab movably mounted on the frame adjacent and aligned with the first lock tab;

a third lock tab on the lock slide;

wherein the third lock tab engages the first lock tab in the locked position to lock the lid to the frame in the closed position and is disengaged from the first lock tab in the unlocked position to allow the lid to move from the closed position to the open position:

and upon fracture of the first lock tab, the third lock tab engages the second lock tab to prevent the lid from moving to the open position.

23. The apparatus of claim 22 wherein the opening in the lid is externally visible in the unlocked and locked positions.

24. An apparatus comprising:

a frame;

an interior chamber formed in the frame adapted to receive an item of merchandise;

a first security feature for preventing removal of the item of merchandise from the frame;

a second security feature comprising a solid item-engaging member in the interior chamber for damaging the item of merchandise upon defeat of the first security feature;

a lid mounted on the frame and movable between a closed position and a fully open position;

a linked portion of the second security feature which is movably mounted on the frame and which is linked to the lid to move therewith in a first direction upon defeat of the first security feature and movement of the lid from the closed position to a partially open position; wherein the linked portion secures the lid to the frame in the partially open position to prevent the lid from moving from the partially open position to the fully open position; and a stop mounted on one of the frame and the second security feature which moves from an inactivated position to an activated position in response to movement of the linked portion in the first direction; and wherein the stop in the activated position engages the other of the frame and second security feature to provide a physical interference which physically blocks movement of the linked portion in a second direction opposite the first direction.

25. The apparatus of claim 24 wherein the other of the frame and second security feature comprises a first ledge; and the stop is engageable with the first ledge in the activated position to provide the physical interference which physically blocks movement of the linked portion in the second direction.

26. The apparatus of claim 25 wherein the other of the frame and second security feature comprises a second ledge parallel to and offset from the first ledge; and the stop is engageable with the second ledge in the activated position to provide the physical interference which physically blocks movement of the linked portion in the second direction.

27. The apparatus of claim 24 wherein the first security feature comprises a lock slide which is slidably mounted on the lid to slide between a locked position to lock the lid to the frame in the closed position and an unlocked position to allow the lid to move from the closed position to the fully open position; and the linked portion engages the lock slide in the partially open position to prevent the lid from moving from the partially open position to the fully open position.

28. An apparatus comprising:

a frame adapted to receive and display an item of merchandise;

an interior chamber formed in the frame;

a lid mounted on the frame and movable between open and closed positions;

a first security feature comprising a lock slide which is slidable between an unlocked position and a locked position to selectively lock the lid to the frame in the closed position to prevent removal of the item of merchandise from the interior chamber;

a second security feature for damaging or preventing removal of the item of merchandise from the interior chamber upon defeat of the first security feature;

an opening formed through the lid;

a finger tab which is an integral part of the lock slide and moves therewith, and which is manually engageable via the opening when the lid is in the closed position;

a locking member movable between a first position which allows the lock slide with its finger tab to slide between the unlocked and locked positions and a second position which secures the lock slide with its finger tab in the locked position;

a security member on the second security feature mounted on the frame within the interior chamber and movable relative to the frame;

a plurality of first lock tabs on the lock slide; and a plurality of second lock tabs on the security member which respectively lockably engage the first lock tabs when the lock slide is in the locked position and respectively release the first lock tabs when the lock slide is in the unlocked position.

29. An apparatus comprising:

a frame;

an interior chamber formed in the frame adapted to receive an item of merchandise;

a first security feature for preventing removal of the item of merchandise from the frame;

a second security feature comprising a solid item-engaging member in the interior chamber for damaging the item of merchandise upon defeat of the first security feature;

a lid mounted on the frame and movable between a closed position and an open position;

a linked portion of the second security feature which is linked to the lid to move therewith in a first direction upon defeat of the first security feature and movement of the lid from the closed position to a partially open position; and a stop mounted on one of the frame and the second security feature which moves from an inactivated position to an activated position in response to movement of the linked portion in the first direction; and wherein the stop in the activated position engages the other of the frame and second security feature to provide a physical interference which physically blocks movement of the linked portion in a second direction opposite the first direction; and wherein a cantilevered prong serves as the stop.

30. The apparatus of claim 29 further comprising a prong plate mounted in the interior chamber; and wherein the prong is cantilevered from the prong plate.

31. The apparatus of claim 29 wherein the other of the frame and second security feature comprises a first ledge; and the prong is engageable with the first ledge in the activated position to provide the physical interference which physically blocks movement of the linked portion in the second direction.

32. The apparatus of claim 31 wherein the other of the frame and second security feature comprises a second ledge parallel to and offset from the first ledge; and the prong is engageable with the second ledge in the activated position to provide the physical interference which physically blocks movement of the linked portion in the second direction.

* * * * *